US011385570B2

(12) United States Patent
Matsumae et al.

(10) Patent No.: US 11,385,570 B2
(45) Date of Patent: Jul. 12, 2022

(54) POWDER LEVELER, POWDER CONTAINER DEVICE, POWDER TRANSPORTER, AND POWDER HANDLING DEVICE

(71) Applicant: FUJIFILM Business Innovation Corp., Tokyo (JP)

(72) Inventors: Shota Matsumae, Kanagawa (JP); Yukihiro Ichiki, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/325,740

(22) Filed: May 20, 2021

(65) Prior Publication Data

US 2022/0121137 A1 Apr. 21, 2022

(30) Foreign Application Priority Data

Oct. 16, 2020 (JP) ..... JP2020-174359

(51) Int. Cl.
*G03G 15/08* (2006.01)

(52) U.S. Cl.
CPC ..... *G03G 15/0889* (2013.01); *G03G 15/0822* (2013.01); *G03G 15/0865* (2013.01); *G03G 15/0875* (2013.01); *G03G 2215/085* (2013.01)

(58) Field of Classification Search
CPC ..... G03G 15/0889; G03G 15/0875; G03G 15/0822; G03G 15/0865; G03G 2215/085
See application file for complete search history.

(56) References Cited

U.S. PATENT DOCUMENTS 8,260,178 B2 * 9/2012 Kuroyama ..... G03G 15/0875 399/263
8,588,661 B2 * 11/2013 Ota ..... G03G 15/0875 399/263
9,599,928 B2 3/2017 Maruyama
(Continued)

FOREIGN PATENT DOCUMENTS

JP 2993623 B2 12/1999
JP 2006276615 A * 10/2006 ..... G03G 15/0822
(Continued)

*Primary Examiner* — Ryan D Walsh
(74) *Attorney, Agent, or Firm* — Sughrue Mion, PLLC

(57) ABSTRACT

A powder leveler includes: a structure having an internal space in which powder moves; a sheet-shaped leveling member that rotates while having a first end thereof attached to a rotation shaft disposed inside the structure, and that comes into contact with part of the powder accumulating at a portion inside the structure close to a free end thereof located away from the rotation shaft to level out the powder; and an obstacle located inside the structure at a position on a rotation path of the leveling member to obstruct the rotation path, the obstacle allowing the leveling member to pass thereby while the leveling member is rotating and being bent as a result of partially coming into contact with the obstacle. The leveling member includes multiple first discontinuous portions in at least a range in which the rotation path is obstructed by the obstacle while the leveling member is rotating, the multiple first discontinuous portions extend inward from an end closer to the free end in a direction obliquely crossing an axis of the rotation shaft, and the first discontinuous portions have terminal ends located within the range.

18 Claims, 13 Drawing Sheets

(56) References Cited

U.S. PATENT DOCUMENTS

| | | | | |
|---|---|---|---|---|
| 10,067,442 | B2 * | 9/2018 | Eto | G03G 15/0877 |
| 2007/0280739 | A1 * | 12/2007 | Tanaka | G03G 15/0808<br>399/254 |
| 2008/0279594 | A1 * | 11/2008 | Sakoh | G03G 15/0877<br>399/262 |
| 2010/0124444 | A1 * | 5/2010 | Kawakami | G03G 15/0822<br>399/281 |
| 2015/0227082 | A1 * | 8/2015 | Fujii | G03G 15/0865<br>399/263 |
| 2015/0261131 | A1 * | 9/2015 | Maeshima | G03G 15/556<br>399/27 |

FOREIGN PATENT DOCUMENTS

| | | | | |
|---|---|---|---|---|
| JP | 2015090401 | A * | 5/2015 | G03G 15/0858 |
| JP | 6547340 | B2 | 7/2019 | |
| KR | 20080008654 | A * | 1/2008 | G03G 15/0877 |

* cited by examiner

POWDER LEVELER, POWDER CONTAINER DEVICE, POWDER TRANSPORTER, AND POWDER HANDLING DEVICE

CROSS-REFERENCE TO RELATED APPLICATIONS

This application is based on and claims priority under 35 USC 119 from Japanese Patent Application No. 2020-174359 filed Oct. 16, 2020.

BACKGROUND

(i) Technical Field

The present disclosure relates to a powder leveler, a powder container device, a powder transporter, and a powder handling device.

(ii) Related Art

Japanese Patent No. 2993623 (particularly, claim 1, paragraph 0027, and FIGS. 1 to 4) describes an electrophotographic device that includes an agitation blade, serving as an agitator, disposed in a waste toner bottle in a portion adjacent to an inlet space of a container chamber below a side space. The agitation blade rotates about a rotation axis. The agitation blade moves toner accumulated around the inlet to the side space to uniformly distribute the accumulated toner.

Japanese Patent No. 2993623 (particularly, claim 1, paragraph 0027, and FIGS. 1 to 4) also describes that the agitation blade is formed from a comb-like mylar blade having rectangular cuts to reduce resistance, and having such a length as to be rotatable without touching an inner wall of a toner storage chamber.

Japanese Patent No. 6547340 (particularly, claim 1, paragraphs 0053 to 0057, and FIGS. 1 to 5) describes a powder container and an image forming apparatus. The powder container includes a container body that accommodates powder, and a powder transporter disposed in the container body. The image forming apparatus includes a developing device that receives powder accommodated in the powder container to develop an electrostatic latent image formed on an image carrier with the powder.

Japanese Patent No. 6547340 (particularly, claim 1, paragraphs 0053 to 0057, and FIGS. 1 to 5) also describes a powder transporter serving as a transporter of the powder. The powder transporter includes a rotation member, a contact member, and multiple protruding portions. The rotation member rotates about an axis in the container accommodating powder. The contact member has a first end fixed to the rotation member, and a second end that is left free to bend when coming into contact with the inner wall of the container. The contact member has multiple cuts arranged in the direction in which the axis of the rotation member extends. Each cut obliquely extends with a starting point at a side closer to the second end and a terminal point closer to the rotation member. The terminal point of each of the multiple cuts is located closer to the first end than to the second end. The multiple protruding portions are arranged in the direction in which the axis of the rotation member extends, and protrude from the rotation member toward the inner wall of the container to agitate powder. The distal ends of all the protruding portions are located at the same position in the axial direction as the center of the cuts in the extension direction, and displaced from the starting points of all the cuts in the axial direction.

SUMMARY

Aspects of non-limiting embodiments of the present disclosure relate to a powder leveler, a powder container device, a powder transporter, and a powder handling device that include a rotation shaft and a rotatable sheet-shaped leveling member attached to a first end of the rotation shaft, and that may vary timing when part of the leveling member makes a sound when being released after coming into contact with an obstacle disposed on the rotation path, and passing by the obstacle while being bent.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a powder leveler including: a structure having an internal space in which powder moves; a sheet-shaped leveling member that rotates while having a first end thereof attached to a rotation shaft disposed inside the structure, and that comes into contact with part of the powder accumulating at a portion inside the structure close to a free end thereof located away from the rotation shaft to level out the powder; and an obstacle located inside the structure at a position on a rotation path of the leveling member to obstruct the rotation path, the obstacle allowing the leveling member to pass thereby while the leveling member is rotating and being bent as a result of partially coming into contact with the obstacle, wherein the leveling member includes a plurality of first discontinuous portions in at least a range in which the rotation path is obstructed by the obstacle while the leveling member is rotating, the plurality of first discontinuous portions extend inward from an end closer to the free end in a direction obliquely crossing an axis of the rotation shaft, and the first discontinuous portions have terminal ends located within the range.

BRIEF DESCRIPTION OF THE DRAWINGS

Exemplary embodiments of the present disclosure will be described in detail based on the following figures, wherein.

DETAILED DESCRIPTION

Forms for embodying the present disclosure (simply referred to as "exemplary embodiments", herein) will be described below with reference to the drawings.

First Exemplary Embodiment

Figure 1:
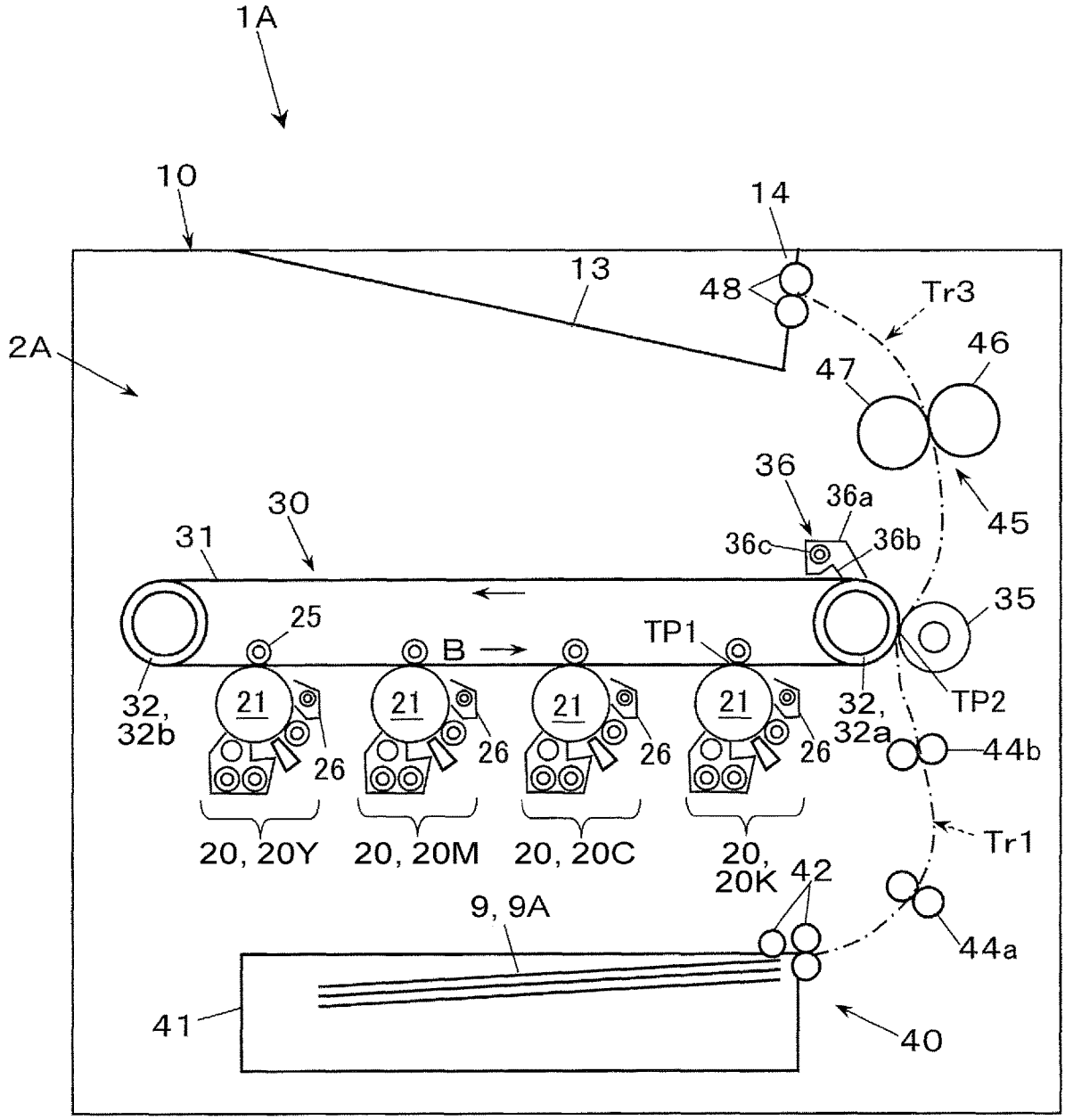
FIG. 1 is a schematic view of an inner structure of an image forming apparatus, which is an example of a powder handling device according to a first exemplary embodiment.
Figure 2:
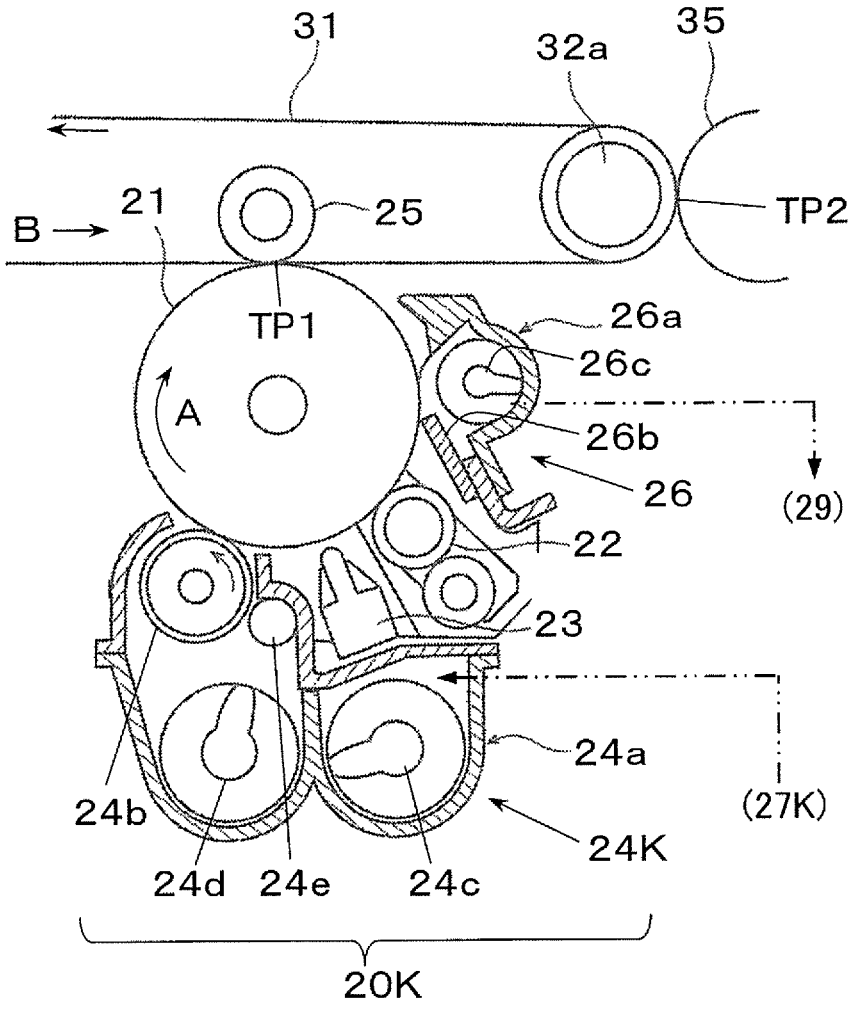
FIG. 2 is a schematic view of an image forming device and its periphery in the image forming apparatus illustrated in FIG. 1.

FIGS. 1 and 2 illustrate an image forming apparatus 1A, which is an example of a powder handling device 1 according to a first exemplary embodiment. FIG. 1 illustrates an internal structure of the image forming apparatus 1A, and FIG. 2 is an enlarged diagram of part of the image forming apparatus 1A.

The image forming apparatus 1A includes an image forming member 2A and a powder container device 6A. The image forming member 2A is an example of a powder applicator 2, which applies a developer (or toner 8A) to a sheet medium 9A such as a paper sheet. The developer is an example of powder 8. The sheet medium 9A is an example of a powder receiving object. The powder container device 6A accommodates a developer reclaimed by the image forming member 2A.

The image forming apparatus 1A according to the first exemplary embodiment forms a visible image formed from a developer on the sheet medium 9A as an image. An example of the image forming apparatus 1A is a printer that forms images or visible images corresponding to image information input from an external connection device such as an information terminal or a personal computer. Examples of a developer include a binary developer containing a nonmagnetic toner 8A and a magnetic carrier. Examples of the image information include information related to images such as characters, figures, photos, and patterns.

The image forming apparatus 1A includes a housing 10 having a box-shaped appearance. The housing 10 includes, for example, a support frame and an exterior panel.

The housing 10 includes an openable side cover, not illustrated, on one side surface. The housing 10 includes a discharge receiver 13 that receives, on its upper surface, sheet media 9A discharged after having images formed thereon. The housing 10 also includes a container mount, not illustrated, on the inner side of the side cover. Various replaceable containers are removably attached to the container mount.

Figure 3:
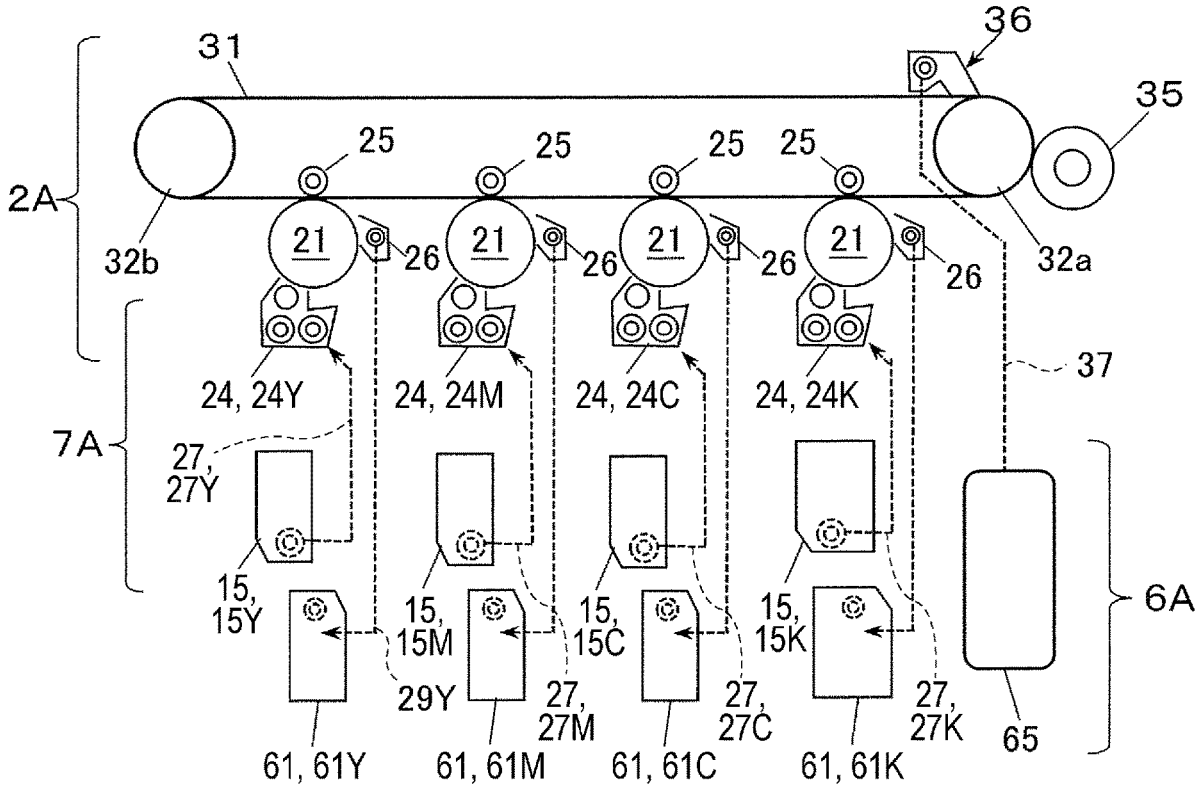
FIG. 3 is a schematic view of a toner replenishment structure and a toner reclaim structure in the image forming apparatus illustrated in FIG. 1.

Examples of the containers include, as illustrated in FIG. 3, replaceable (cartridge) developer containers 15, which are examples of a powder container that accommodates a developer to be replenished (mostly, toner 8A), first reclaim containers 61 that accommodate a developer (mostly, toner 8A) to be reclaimed by first cleaning devices 26 described later, and a second reclaim container 65 that accommodates a developer (mostly, toner 8A) to be reclaimed by a second cleaning device 36, described later.

The developer containers 15 among these containers include four developer containers 15Y, 15M, 15C, and 15K that respectively accommodate four color toners, described later. The first reclaim containers 61 include four first reclaim containers 61Y, 61M, 61C, and 61K that separately accommodate the developers reclaimed by the respective first cleaning devices 26 in four image forming devices 20 (20Y, 20M, 20C, and 20K), described later.

As illustrated in FIG. 1, the image forming member 2A includes, for example, the image forming devices 20, which form visible images based on image information, an intermediate transfer device 30, which temporarily holds the visible images formed by the image forming devices 20 and then second-transfers the visible images to the sheet media 9A, a sheet feeding device 40, which accommodates and feeds the sheet media 9A that are to be fed to a second transfer position at which the intermediate transfer device 30 performs second transfer, and a fixing device 45, which fixes the visible images second-transferred by the intermediate transfer device 30 to the sheet media 9A. This image forming member 2A is an image forming apparatus of an intermediate transfer system.

The image forming devices 20 include four image forming devices 20 (20Y, 20M, 20C, and 20K) that dedicatedly form, with electrophotography, visible images of four colors of yellow (Y), magenta (M), cyan (C), and black (K).

FIG. 2 illustrates the black image forming device 20K by way of example. Each of these four image forming devices 20 (20Y, 20M, 20C, and 20K) include a drum-shaped photoconductor 21, which is an example of an image carrier driven to rotate in the direction of arrow A. Around the photoconductor 21, devices such as a charging device 22, an exposure device 23, one of developing devices 24 (24Y, 24M, 24C, and 24K), a first transfer device 25, and a first cleaning device 26 are arranged.

The charging device 22 charges an outer peripheral surface (an image receivable surface) of the photoconductor 21 with electricity of a predetermined surface potential. The exposure device 23 exposes the outer peripheral surface of the photoconductor 21 with light corresponding to image signals of color components (Y, M, C, and K) generated based on the image information to form electrostatic latent images. The developing devices 24 (24Y, 24M, 24C, and 24K) develop the electrostatic latent images formed on the outer peripheral surface of the photoconductor 21 with the developer (toner) of the corresponding colors (Y, M, C, and K) to form toner images or visible images.

The first transfer device 25 electrostatically transfers toner images of the respective colors to the intermediate transfer device 30 (or to an intermediate transfer belt 31 of the intermediate transfer device 30). The first cleaning device 26 cleans the outer peripheral surface of the photoconductor 21 by scraping unwanted matter such as unwanted toner or paper dust adhering to the outer peripheral surface of the photoconductor 21 for removal.

The developing devices 24 (24Y, 24M, 24C, and 24K) have the same structure except that they handle the developers of different colors. Specifically, as the developing device 24K illustrated in FIG. 2 by way of example, the developing devices 24 (24Y, 24M, 24C, and 24K) each include, in a housing 24*a* having a container shape and having a developer containing chamber and a development opening, a developing roller 24*b*, which holds the developer to feed the developer to a development portion of the photoconductor 21 facing the development opening, agitating transporting members 24*c* and 24*d* such as screw augers that transport the developer accommodated in the developer containing chamber of the housing 24*a* while agitating the developer, and an adjusting member 24*e*, which adjusts the amount (thickness) of the developer held on the developing roller 24*b*.

The developing devices 24 (24Y, 24M, 24C, and 24K) will be described using the developing device 24K by way of example. A black toner charged by friction by being agitated with the agitating transporting members 24*c* and 24*d* electrostatically adheres to the electrostatic latent image on the photoconductor 21 from the developing roller 24*b*, to develop the electrostatic latent image to form a black toner image, which is a visible image.

An example used as the first transfer device 25 is a contact transfer device including a first transfer roller, which is an example of a contact transfer member receiving a first transfer current.

The first cleaning device 26 includes a container body 26*a*, and in the container body 26*a*, a contact cleaning member 26*b*, which scrapes unwanted matter (mostly, toner), and a transporting member 26*c* such as a screw auger that reclaims the unwanted matter scraped by the contact cleaning member 26*b* and transports the unwanted matter to a first reclaim container 61 (61Y, 61M, 61C, or 61K).

In each of the image forming devices 20 (20Y, 20M, 20C, and 20K), a position where the photoconductor 21 and a first transfer roller of the first transfer device 25 faces each other (with the intermediate transfer belt 31 interposed therebetween) serves as a first transfer position TP1 where toner images are first-transferred.

When each of the image forming devices 20 (20Y, 20M, 20C, and 20K) receives a command of an image forming operation via a controller, not illustrated, in response to an instruction of image formation from, for example, an external connection device, the image forming device 20 forms a toner image of one of four colors (Y, M, C, and K) on the corresponding photoconductor 21, and first-transfers the toner image thus formed to the intermediate transfer device 30 (the intermediate transfer belt 31 of the intermediate transfer device 30) at the first transfer position TP1.

As illustrated in FIG. 1, the intermediate transfer device 30 includes the intermediate transfer belt 31, which is an example of an intermediate transfer body to which toner images are first-transferred from the photoconductors 21 of the image forming devices 20 (20Y, 20M, 20C, and 20K) and that holds the toner images. Around the intermediate transfer belt 31, components including first transfer devices 25, a second transfer device 35, and a second cleaning device 36 are arranged.

The intermediate transfer belt 31 is an endless belt that may electrostatically hold toner images. The intermediate transfer belt 31 is supported by multiple support rollers 32 (for example, two support rollers 32*a* and 32*b*) disposed on the inner side of the intermediate transfer belt 31, to rotate in the direction of arrow B while sequentially passing the first transfer positions TP1 of the image forming devices 20 (20Y, 20M, 20C, and 20K).

Each first transfer device 25 is driven to rotate on the inner side of the intermediate transfer belt 31 while having the first transfer roller pressing the intermediate transfer belt 31 against the photoconductor 21.

The second transfer device 35 is disposed to allow a sheet medium 9A to pass thereby at its outer peripheral surface supported by the support roller 32*a* of the intermediate transfer belt 31, and to second-transfer the toner image on the intermediate transfer belt 31 to the sheet medium 9A. An example used as the second transfer device 35 according to the first exemplary embodiment is a contact transfer device including a second transfer roller, which is an example of a contact transfer member to which a second transfer current is fed.

As illustrated in FIG. 1, the second cleaning device 36 includes, inside a container body 36*a*, components including a contact cleaning member 36*b* that scrapes unwanted matter (mostly, toner), and a transporting member 36*c* such as a screw auger that reclaims the unwanted matter scraped by the contact cleaning member 36*b* and transports the unwanted matter to the second reclaim container 65.

In the intermediate transfer device 30, a position where the second transfer device 35 (second transfer roller of the second transfer device 35) is in contact with the outer peripheral surface of the intermediate transfer belt 31 serves as a second transfer position TP2 where toner images are second-transferred.

In the intermediate transfer device 30, during an image forming operation, when a toner image is first-transferred to the outer peripheral surface of the intermediate transfer belt 31, the intermediate transfer device 30 transports the toner image to the second transfer position TP2 with rotation of the intermediate transfer belt 31, and second-transfers the toner image to the sheet medium 9A.

The sheet feeding device 40 accommodates sheet media 9A to be fed to the second transfer position TP2 of the intermediate transfer device 30, and feeds the sheet media 9A. The sheet feeding device 40 according to the first exemplary embodiment includes a drawable container 41 that accommodates a stack of the sheet media 9A, and a pick-up device 42 that feeds the sheet medium 9A accommodated in the container 41 one by one.

As illustrated in FIG. 1, a feed transport path Tr1 is disposed between the sheet feeding device 40 and the second transfer position TP2 of the intermediate transfer device 30 to allow the sheet medium 9A to be transported to the second transfer position TP2. The feed transport path Tr1 includes, for example, pairs of transport rollers 44*a* and 44*b* that transport the sheet medium 9A while holding the sheet medium 9A therebetween, and a guide member, not illustrated, that secures a transport space for the sheet medium 9A to guide the sheet medium 9A.

Examples used as the sheet medium 9A in the image forming apparatus 1A may be any recording medium transportable in the housing 10 and that allows toner images to be transferred or fixed thereto, such as ordinary sheets, coated sheets, or cardboard. The material or form of the sheet medium 9A is not limited to a particular one.

The fixing device 45 includes, inside a housing not illustrated having an inlet port and an outlet port for the sheet medium 9A, a heating rotator 46 having a roller form and including a heater not illustrated, and a pressing rotator 47 having a roller form. The fixing device 45 has a portion that comes into contact with the heating rotator 46 and the pressing rotator 47 serving as a nip (fixing processor) that heats and presses an unfixed toner image to fix the toner image to the sheet medium 9A.

In the fixing device 45, during the image forming operation, a sheet medium 9A to which a toner image has been second-transferred at the second transfer position TP2 is transported to be introduced to and pass through the nip. Thus, the toner image on the sheet medium 9A is heated and melted at the nip to be fixed to the sheet medium 9A.

As illustrated in FIG. 1, a discharge transport path Tr3 is disposed between the fixing device 45 and an outlet port 14 formed in the housing 10. The discharge transport path Tr3 allows a sheet medium 9A subjected to fixing to be discharged therealong to the discharge receiver 13. The discharge transport path Tr3 includes a pair of discharging rollers 48 in front of the outlet port 14, and a guide member, not illustrated, that secures a transport space for the sheet medium 9A to guide the sheet medium 9A.

During the image forming operation, a sheet medium 9A subjected to fixing by the fixing device 45 passes the discharge transport path Tr3 and is discharged to and received in the discharge receiver 13.

For example, the image forming apparatus 1A may selectively form a multicolor image (full-color image) by operating all the four image forming devices 20 (20Y, 20M, 20C, and 20K) to combine toner images of four colors (Y, M, C, and K), or a monochrome image (for example, black image) by operating one of the four image forming devices 20 (20Y, 20M, 20C, and 20K) to form a toner image of a single color.

Structure Relating to Toner Replenishment

In the image forming apparatus 1A, the developing devices 24 (24Y, 24M, 24C, and 24K) consume and reduce the developer (toner) through a developing operation. Thus, as illustrated in FIG. 3, the developing devices 24 (24Y, 24M, 24C, and 24K) are replenished with toner accommodated in the developer containers 15 (15Y, 15M, 15C, and 15K).

Thus, each of the developing devices 24 (24Y, 24M, 24C, and 24K) includes a receiving portion at a portion obtained by extending one end of the agitating transporting member 24*c* toward the above-described container mount, not illustrated. The receiving portion includes a reception port and an openable lid, not illustrated. The reception port receives replenished toner.

As schematically illustrated in FIG. 3, on the container mount of the housing 10, replenishment transporters 27 (27Y, 27M, 27C, and 27K) and a driving force transmitter, not illustrated, are disposed. Each of the replenishment transporters 27 (27Y, 27M, 27C, and 27K) connects the receiving portion of the corresponding one of the developing devices 24 (24Y, 24M, 24C, and 24K) and the corresponding one of the developer containers 15 (15Y, 15M, 15C, and 15K) to transport toner to be replenished. The driving force transmitter transmits rotation power to a discharging member disposed in each of the developer containers 15 (15Y, 15M, 15C, and 15K). The discharging member will be described later.

The replenishment transporters 27 (27Y, 27M, 27C, and 27K) and the driving force transmitters protrude from the container mount, not illustrated, disposed on the side surface of the housing 10 to allow the developer containers 15 (15Y, 15M, 15C, and 15K) to be accommodated and mounted thereon.

The replenishment transporters 27 (27Y, 27M, 27C, and 27K) constitute a powder transporter 7A that transports toner, or an example of powder. The replenishment transporters 27 (27Y, 27M, 27C, and 27K) each include a transport tube and a transporting member. The transport tube is an example of a transport path structure that forms a transport space connecting the receiving portion and the corresponding one of the developer containers 15 (15Y, 15M, 15C, and 15K). The transporting member rotates in the transport tube at desired timing to transport the toner. The reception port and the openable lid, not illustrated, are disposed at the upper surface of the end portion of the corresponding one of the replenishment transporters 27 (27Y, 27M, 27C, and 27K) protruding from the container mount. A connection gear, not illustrated, is exposed from the end portion of the driving force transmitter protruding from the container mount.

The developer containers 15 (15Y, 15M, 15C, and 15K) are containers with a predetermined shape. Each of the developer containers 15 (15Y, 15M, 15C, and 15K) includes a connection portion having an outlet port at a lower portion of the developer container 15. The corresponding one of the replenishment transporters 27 (27Y, 27M, 27C, and 27K) is inserted into and connected to the outlet port. A discharging member such as a screw auger is disposed in each developer container 15. The discharging member is driven to rotate to transport toner accommodated in the container by a predetermined amount to the corresponding one of the replenishment transporters 27 (27Y, 27M, 27C, and 27K).

When each of the developer containers 15 (15Y, 15M, 15C, and 15K) is mounted to the container mount, the corresponding one of the replenishment transporters 27 (27Y, 27M, 27C, and 27K) is inserted into and connected to the connection portion of the developer container 15, and the discharging member is connected to the driving force transmitter.

A controller, not illustrated, of each of the developer containers 15 (15Y, 15M, 15C, and 15K) controls the driving force transmitter to operate the driving force transmitter for a predetermined time period in accordance with detected information. Thus, the discharging member rotates by a predetermined amount to discharge the toner in the container to the corresponding one of the replenishment transporters 27 (27Y, 27M, 27C, and 27K). The discharged toner is fed to the corresponding one of the developing devices 24 (24Y, 24M, 24C, and 24K) with transport power of the corresponding one of the replenishment transporters 27 (27Y, 27M, 27C, and 27K).

Structure Relating to Accommodation of Reclaimed Toner

As illustrated in FIG. 3, in the image forming apparatus 1A, unwanted matter (mostly, toner) reclaimed by the first cleaning device 26 of each of the image forming devices 20 (20Y, 20M, 20C, and 20K) is accommodated in the corresponding one of the first reclaim containers 61 (61Y, 61M, 61C, and 61K), which is an example of a container structure.

The transporting member 26*c* in the first cleaning device 26 is thus disposed on a first reclaim transporter 29 (FIG. 2), extending to protrude from the first cleaning device 26 toward the container mount of the housing 10. The first reclaim transporter 29 has an outlet port and an openable lid, not illustrated, on the lower surface of the end portion protruding from the container mount.

Figure 4:
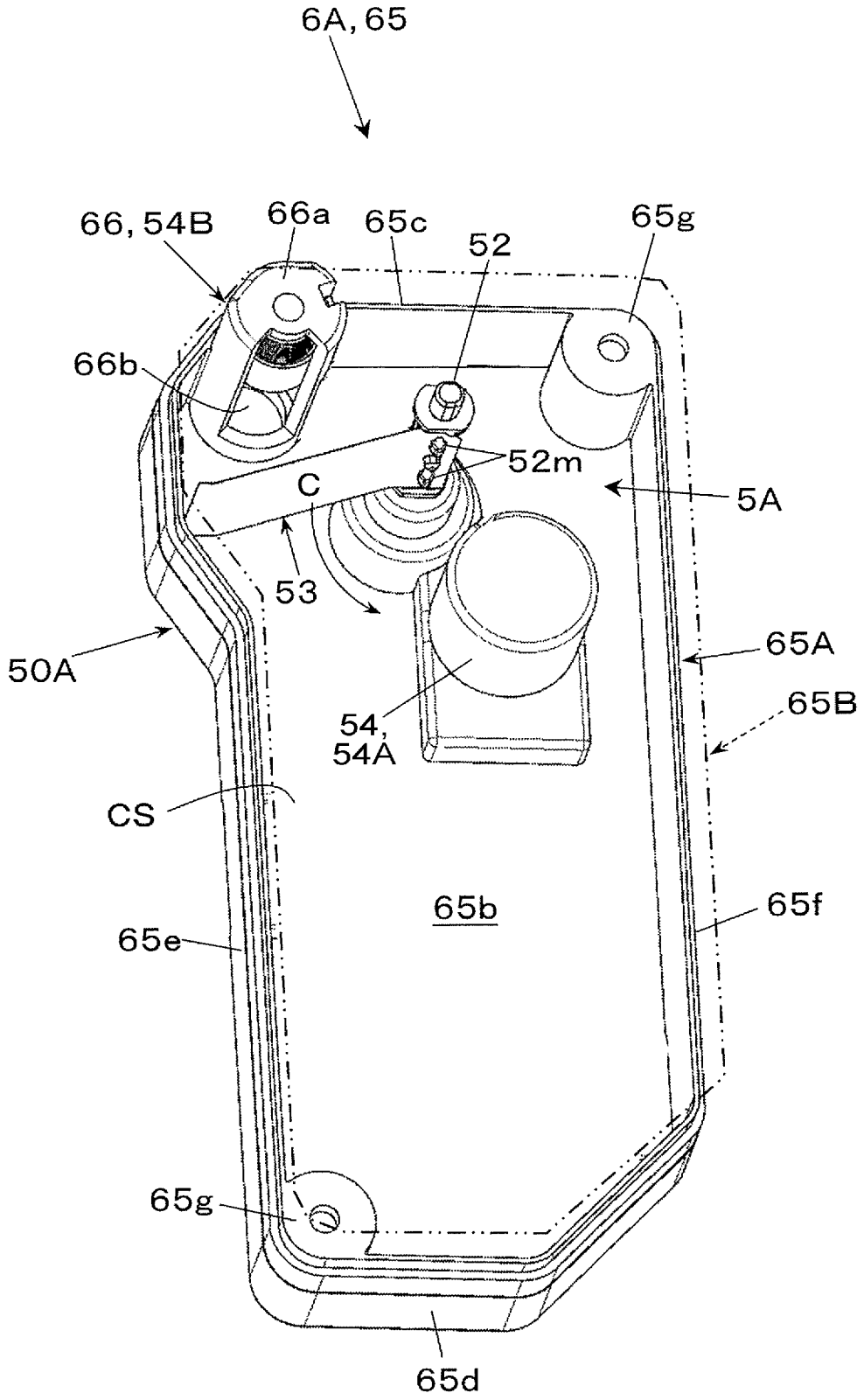
FIG. 4 is a perspective view of a half of a disassembled container structure in a powder container device including the powder leveler in the image forming apparatus illustrated in FIG. 1.

The first reclaim containers 61 (61Y, 61M, 61C, and 61K) are containers according to the first exemplary embodiment with a predetermined shape. As illustrated in FIG. 4, each of the first reclaim containers 61 includes a connection portion 66 that has a reclaim port 66*b* at an upper portion of the first reclaim container 61. The first reclaim transporter 29 is inserted into and connected to the reclaim port 66*b*.

When each of the first reclaim containers 61 (61Y, 61M, 61C, and 61K) is mounted on the container mount, the distal end of the first reclaim transporter 29 is inserted into and connected to the connection portion of the container mount.

When the image forming device 20 is in operation, in each of the first reclaim containers 61 (61Y, 61M, 61C, and 61K), unwanted matter, or mostly toner, reclaimed by the corresponding first cleaning device 26 is transported by the first reclaim transporter 29, and accommodated in the container.

The first reclaim containers 61 (61Y, 61M, 61C, and 61K) may be integrated as a single reclaim container. For a single integrated first reclaim container 61, unwanted matter, or mostly toner, reclaimed by the respective first cleaning devices 26 is collectively accommodated in the single first reclaim container 61.

In the image forming apparatus 1A, unwanted matter (mostly, toner) reclaimed by the second cleaning device 36 in the intermediate transfer device 30 is reclaimed by the second reclaim container 65 constituting part of the powder container device 6A.

Thus, the transporting member 36*c* in the second cleaning device 36 is disposed on a second reclaim transporter 37 (FIG. 3), which extends to protrude from the second cleaning device 36 toward the container mount of the housing 10, not illustrated. The second reclaim transporter 37 has an outlet port and an openable lid, not illustrated, at a lower surface of the end portion protruding from the container mount.

The second reclaim container 65 serves as a container structure constituting part of the powder container device 6A and having an accommodation space CS that accommodates toner.

As illustrated in FIG. 4, the second reclaim container 65 according to the first exemplary embodiment is a container with a predetermined shape such as a long box, and has a structure including a first container 65A and a second container 65B, or front and rear halves integrated together. The first container 65A includes a side wall 65*b*, and an upper surface 65*c*, a bottom surface 65*d*, and two vertical side surfaces 65*e* and 65*f* surrounding the side wall 65*b*. At coupling portions 65*g* in FIG. 4, the first container 65A and the second container 65B are fastened with bolts and screws to be assembled together.

The second reclaim container 65 includes the connection portion 66 at an upper portion. The second reclaim transporter 37 is inserted into the connection portion 66 from the side wall 65*b* for connection. The connection portion 66 includes a cylindrical body 66*a* and a toner reclaim port 66*b* formed in the lower surface of the body 66*a* at the distal end.

When the second reclaim container 65 is mounted on the container mount, the distal end of the second reclaim transporter 37 is inserted into and connected to the connection portion 66 of the second reclaim container 65.

When the image forming device 20 and the intermediate transfer device 30 are in operation, unwanted matter, mostly toner, reclaimed by the second cleaning device 36 is transported to the second reclaim container 65 by the second reclaim transporter 37, and falls into the accommodation space CS through the reclaim port 66*b* of the connection portion 66 to be accommodated in the accommodation space CS.

Powder Container Device Including Leveler

Into the second reclaim container 65, which is a container structure constituting part of the powder container device 6A, the toner 8A that falls into and is accommodated in a container or the accommodation space CS gradually accumulates in an arc shape. As illustrated in FIG. 4 or 5, the connection portion 66 in the second reclaim container 65 including the reclaim port 66*b* is located at a one-sided position (for example, a corner) with respect to an upper center of the second reclaim container 65.

Figure 5A:
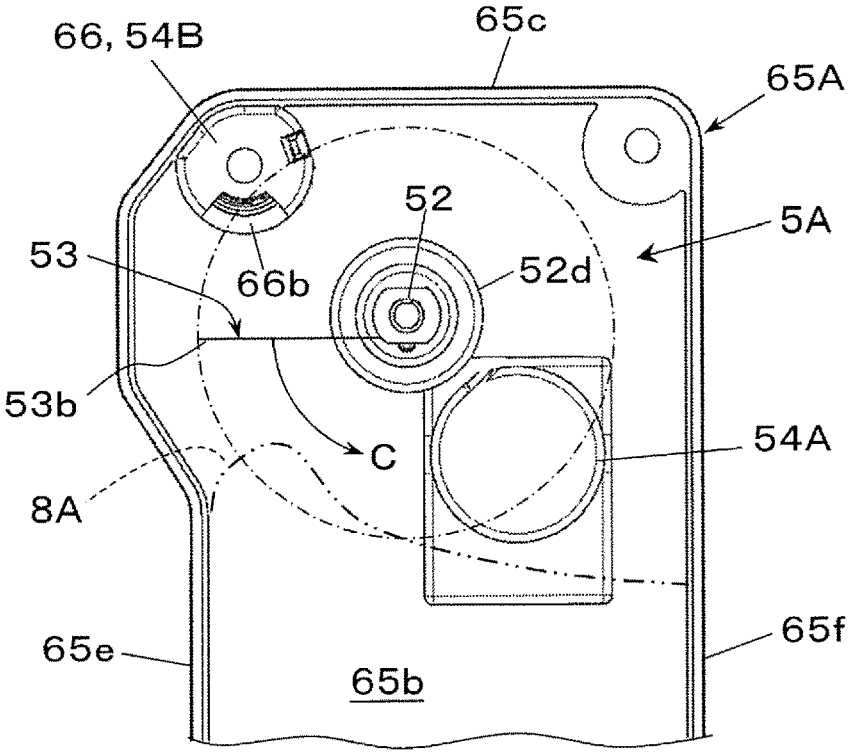
FIG. 5A is a schematic view of a structure of the powder leveler illustrated in FIG. 4.

Thus, as illustrated in FIG. 5A with a two-dot chain line, the toner 8A accommodated in the second reclaim container 65 also accumulates at a one-sided portion in the container, and part of the toner 8A accumulating at the one-sided portion has to be leveled out.

Figure 5B:
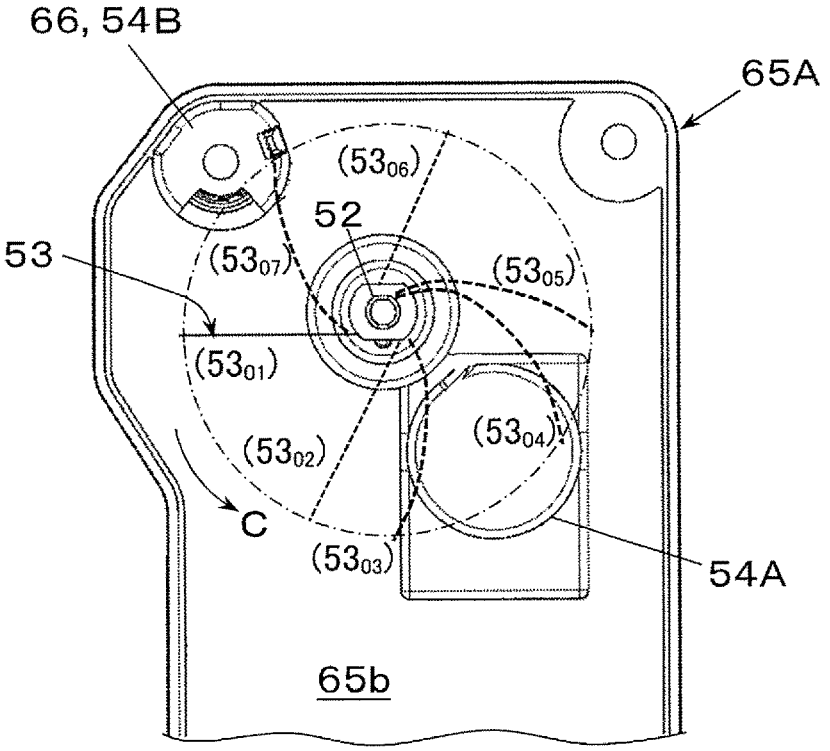
FIG. 5B is a schematic view of the powder leveler illustrated in FIG. 5A in operation.
Figure 6:
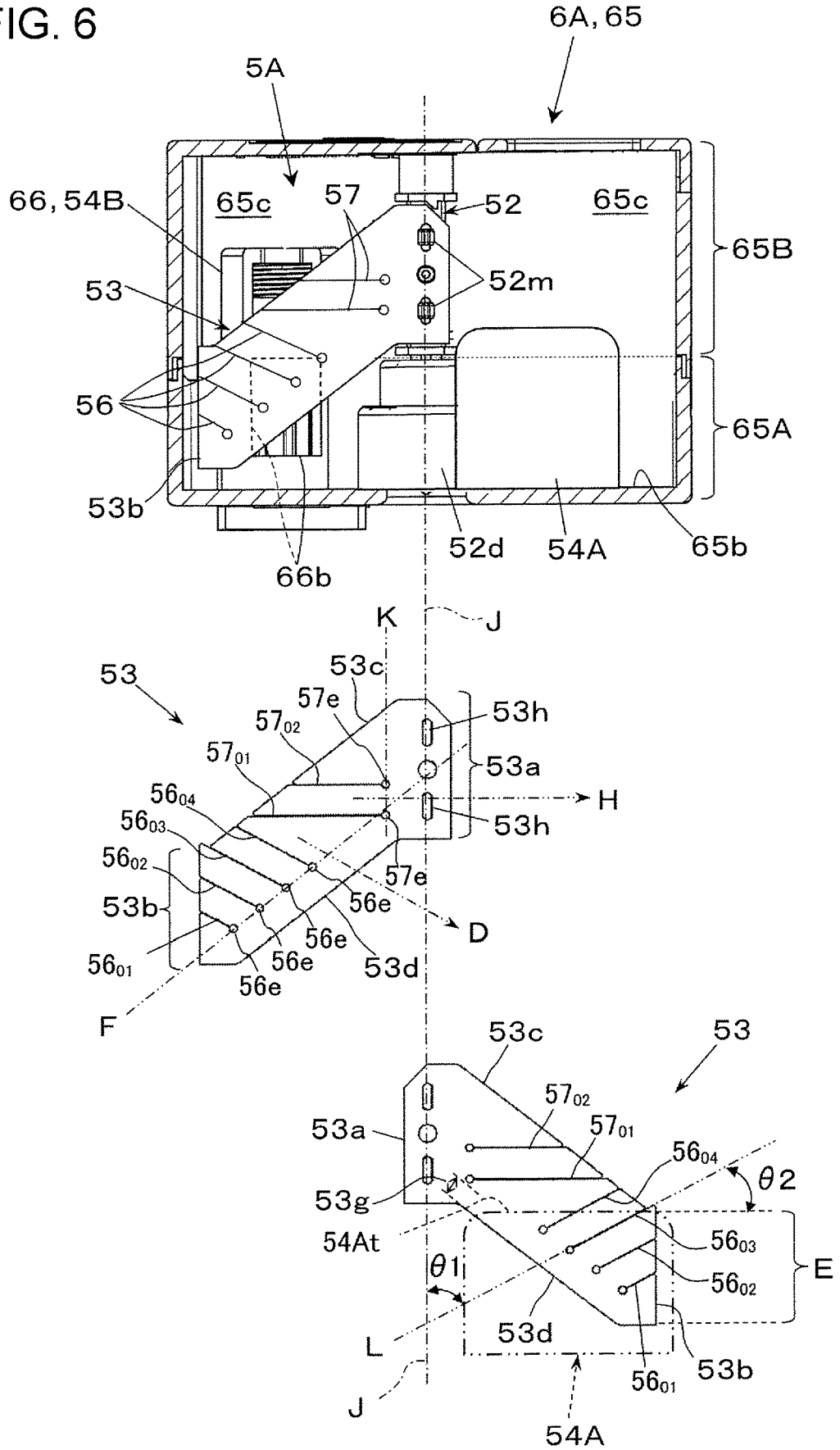
FIG. 6 is a schematic view of the powder leveler illustrated in FIG. 4 when viewed from the bottom, and the structure of a leveling member.

As illustrated in FIGS. 4 to 6, the second reclaim container 65 includes a powder leveler 5A. The powder leveler 5A includes a rotation shaft 52 and a sheet-shaped leveling member 53. The rotation shaft 52 is rotatably disposed inside the second reclaim container 65. The leveling member 53 rotates while having a first end 53*a* attached to the rotation shaft 52, to come into contact with or level out the toner 8A accumulating at the portion near a free end 53*b*, located farther from the rotation shaft 52.

The powder leveler 5A is disposed so that the rotation shaft 52 crosses the inside of the second reclaim container 65 at substantially the center portion of an upper portion of the side wall 65*b*. The rotation shaft 52 rotates in the direction of arrow C upon receiving power fed from the driving force transmitter on the container mount on which the second reclaim container 65 is mounted. The rotation shaft 52 keeps rotating while the toner 8A to be reclaimed is being received. A connection supporter 52*d* with a double-stack cylindrical shape illustrated in FIGS. 4 and 5 and other drawings supports the rotation shaft 52 and connects the rotation shaft 52 to the driving force transmitter.

The leveling member 53 is attached to the rotation shaft 52 while allowing multiple headed protrusions 52*m* in the rotation shaft 52 to be inserted into mount holes 53*h* (FIG. 6) formed at the first end 53*a* to prevent unlocking. The leveling member 53 is formed from, for example, a flexible sheet made of a synthetic resin such as polyethylene terephthalate (PET).

The leveling member 53 of the powder leveler 5A rotates in the direction of arrow C substantially about the rotation shaft 52, and comes into contact with part of the toner 8A accumulated at a portion closer to the free end 53*b* of the leveling member 53, farther from the rotation shaft 52, to move the toner 8A downward in a rotation direction C to level out the toner 8A.

However, this second reclaim container 65 includes a structure serving as obstacles 54 located inside to obstruct part of the rotation path (the range of the circle drawn with a dot-and-dash line in FIGS. 5A and 5B and other drawings) of the leveling member 53, so that the rotating leveling member 53 passes by the obstacles 54 while being partially bent by coming into contact with the obstacles 54.

The structures serving as the obstacles 54 in the second reclaim container 65 include a cylindrical protruding portion 54A located adjacent to and obliquely below the rotation shaft 52, and the connection portion 66 located apart from and obliquely above the rotation shaft 52.

As illustrated in an upper portion in FIG. 6, in the second reclaim container 65, the rotation shaft 52 is located closer to one side in the container in the front-rear direction. The reclaim port 66*b* of the connection portion 66 is located closer to one side in the container in the front-rear direction, away from the rotation shaft 52.

Thus, in the leveling member 53, the first end 53*a* is attached to the one-sided rotation shaft 52, and the free end 53*b* has to pass at least a portion below the reclaim port 66*b* of the connection portion 66. Thus, as illustrated in the upper portion in FIG. 6, the leveling member 53 has such a shape that the first end 53*a* and the free end 53*b* are displaced in the direction of an axis J of the rotation shaft 52.

Specifically, the leveling member 53 has a substantially parallelogram in a plan view. In other words, the leveling member 53 is a member having a portion located further outward in the direction of the axis J of the rotation shaft 52 than the first end 53*a* attached to the rotation shaft 52.

From the above description, in the powder leveler 5A, when the leveling member 53 with the above shape rotates in the direction of arrow C about the rotation shaft 52, the leveling member 53 comes into contact with the protruding portion 54A and the connection portion 66 serving as the obstacles 54 while rotating. Thus, as illustrated in FIG. 5B, when coming into contact with the protruding portion 54A and the connection portion 66, part of the leveling member 53 passes by the protruding portion 54A and the connection portion 66 while being temporarily bent backward in the direction opposite to the rotation direction C.

Parenthesized reference signs $\mathbf{53}_{01}$, $\mathbf{53}_{02}$, and $\mathbf{52}_{06}$ in FIG. 5B denote the leveling member 53 not bent or restored after being bent. A reference sign $\mathbf{53}_{03}$ denotes the leveling member 53 when being bent after coming into contact with the protruding portion 54A serving as the obstacle 54. A reference sign $\mathbf{53}_{07}$ denotes the leveling member 53 when being bent after coming into contact with the connection portion 66 serving as the obstacle 54.

In this case, the leveling member 53 is released immediately after the portion bent by coming into contact with the protruding portion 54A and the connection portion 66 serving as the obstacles 54 passes by the protruding portion 54A and the connection portion 66. The portion of the leveling member 53 makes sounds when being released. The sounds are caused at the same timing, unlike in the case where the leveling member 53 has first discontinuous portions 56, described below. The sounds are kept being caused while the leveling member 53 is rotating, and may be grating noise.

A parenthesized reference sign $\mathbf{53}_{04}$ in FIG. 5B denotes the leveling member 53 immediately before completely passing by the protruding portion 54A serving as the obstacle 54 while being in contact with the protruding portion 54A, and a reference sign $\mathbf{53}_{05}$ denotes the leveling member 53 while being restored after being released from the bent state immediately after passing by the protruding portion 54A serving as the obstacle 54.

As illustrated in the upper portion in FIG. 6, the powder leveler 5A includes multiple first discontinuous portions 56 in a portion within a range E in which the rotation path for the leveling member 53 is at least obstructed by the protruding portion 54A and the connection portion 66 serving as obstacles. The first discontinuous portions 56 extend inward from the end closer to the free end 53*b* in a direction D, which obliquely crosses the axis J of the rotation shaft 52, and each have a terminal end 56*e* located within the range E.

Here, as illustrated in a lower portion in FIG. 6, the obstructed range E is a portion where the leveling member 53 positionally overlaps, for example, the protruding portion 54A serving as an obstacle, while rotating immediately before coming into contact with the protruding portion 54A to interfere with the protruding portion 54A.

The end closer to the free end 53*b* includes the free end 53*b* and an end adjacent to or continuous with the free end 53*b*.

Being located within the range E means that the terminal end 56*e* is located at any position within the range E instead of being located outward beyond the range E. In FIG. 6, the terminal ends 56*e* of the first discontinuous portions 56 are drawn as small open circles. These small open circles are formed for the processing purposes for forming the first discontinuous portions 56 and as preventive measures against expansion or breakage of the first discontinuous portions 56.

The multiple first discontinuous portions 56 according to the first exemplary embodiment are cuts formed by cutting into the leveling member 53. Specifically, the first discontinuous portions 56 are four straight cuts.

Thus, the range E in which at least the path for the leveling member 53 is obstructed by the protruding portion 54A serving as an obstacle is divided with the four first discontinuous portions 56. In the first exemplary embodiment, the range E is divided into five strips.

As illustrated in FIG. 6, each of the four first discontinuous portions 56 ($\mathbf{56}_{01}$, $\mathbf{56}_{02}$, $\mathbf{56}_{03}$, and $\mathbf{56}_{04}$) is a straight cut that extends inward in the direction D obliquely crossing the axis J from the free end 53*b* and a first adjacent end 53*c*, which is adjacent to the free end 53*b* on one side, and has the terminal end 56*e* located within the range E at a position immediately before a second adjacent end 53*d*, which is adjacent to the free end 53*b* on the other side and parallel to the first adjacent end 53*c*.

The first discontinuous portion $\mathbf{56}_{04}$ of the four first discontinuous portions 56 extends inward from the first adjacent end 53*c*.

As illustrated in FIG. 6, the first discontinuous portions 56 are four straight cuts arranged equidistantly. With this relationship, the four first discontinuous portions 56 are parallel to each other.

As illustrated in the lower portion in FIG. 6, when one of the first discontinuous portions 56 is extended from the terminal end 56*e* toward the rotation shaft 52 in the form of an extension line L, a crossing angle θ1 between the extension line L and the axis J of the rotation shaft 52 is, for example, within a range of larger than or equal to 30° and smaller than or equal to 45°. When the crossing angle θ1 is viewed from another point using a crossing angle θ2 between the extension line L and a flat top end surface 54At of the protruding portion 54A serving as an obstacle, the crossing angle θ2 is, for example, within a range of larger than or equal to 45° and smaller than or equal to 60°.

When the crossing angle θ1 is smaller than 30°, sounds caused when the leveling member 53 is released after coming into contact with, passing by, and being released from the protruding portion 54A or other portions serving as obstacles while rotating may be caused at substantially the same timing. On the other hand, also when the crossing angle θ1 is larger than 45°, sounds caused when the leveling member 53 is released after coming into contact with, passing by, and being released from the protruding portion 54A or other portions serving as obstacles while rotating may be caused at substantially the same timing.

As illustrated in the middle portion in FIG. 6, the first discontinuous portions 56 have the terminal ends 56*e* aligned on one virtual straight line F obliquely crossing the axis J of the rotation shaft 52.

In the first exemplary embodiment, the terminal ends 56*e* of the first discontinuous portions 56 are located at positions the same distance inward from the linear edge of the second adjacent end 53*d* of the leveling member 53. The terminal ends 56*e* of the first discontinuous portions 56 are preferably located at positions closer to the end (second adjacent end 53*d*, in this example) of the leveling member 53 away from the first adjacent end 53*c* with respect to the middle of the width of the leveling member 53 in the direction D in which the first discontinuous portions 56 are cut. More preferably, the terminal ends 56*e* are located at such positions that the first discontinuous portions 56 are longer than or equal to ⅔ of the width of the leveling member 53.

As illustrated in FIG. 6, in the powder leveler 5A, the leveling member 53 includes second discontinuous portions 57 in a portion that does not come into contact with the protruding portion 54A serving as an obstacle. The second discontinuous portions 57 extend midway in a direction H crossing the axis J of the rotation shaft 52, to partially separate the portion that comes into contact with and passes by the protruding portion 54A serving as an obstacle.

Here, in the first exemplary embodiment, the portion that does not come into contact with the protruding portion 54A is a range smaller than the range E that has a part coming into contact with the connection portion 66 or a second obstacle, and another part coming into contact with the protruding portion 54A. The second discontinuous portions 57 are formed in the leveling member 53 to separate the portion that actually comes into contact with the protruding portion 54A serving as an obstacle from the portion that does not come into contact with the protruding portion 54A.

The portion that comes into contact with and passes by the protruding portion 54A at least includes the range E.

The second discontinuous portions 57 according to the first exemplary embodiment are cuts in the leveling member 53. Specifically, the second discontinuous portions 57 are two straight cuts.

The second discontinuous portions 57 extend in the direction H substantially perpendicular to the axis J.

Thus, in the leveling member 53, the range E is divided from the portion that does not come into contact with the protruding portion 54A with respect to the two second discontinuous portions 57, and the portion that does not come into contact with the protruding portion 54A is further divided with the two second discontinuous portions 57. In the first exemplary embodiment, the portion that does not come into contact with the protruding portion 54A is divided into two strips.

Each of the two second discontinuous portions 57 ($\mathbf{57}_{01}$ and $\mathbf{57}_{02}$) has a terminal end 57*e* located at a position close to the rotation shaft 52. In the first exemplary embodiment, as illustrated in the middle portion in FIG. 6, the terminal ends 57*e* of the two second discontinuous portions 57 are aligned on a virtual straight line K parallel to the direction of the axis J of the rotation shaft 52.

The second discontinuous portions 57 are located closer to the protruding portion 54A serving as an obstacle.

The second discontinuous portion $\mathbf{57}_{01}$ of the two second discontinuous portions 57 ($\mathbf{57}_{01}$ and $\mathbf{57}_{02}$) is located close to the top end surface 54At of the protruding portion 54A serving as an obstacle. The second discontinuous portion $\mathbf{57}_{01}$ is preferably located such that the distance from the side wall 65*b* to the leveling member 53, when attached to the rotation shaft 52, is slightly larger (for example, 5 to 10 mm) than the height of the protruding portion 54A serving as an obstacle. The terminal end 57*e* of the second discontinuous portion $\mathbf{57}_{01}$ is located at a position close to the end of the second adjacent end 53*d* closer to the rotation shaft 52 to minimize a connection portion 53*g* between the range E of the leveling member 53 and the first end 53*a* attached to the rotation shaft 52.

Subsequently, the operation of the powder leveler 5A will be described.

The powder leveler 5A keeps rotating the rotation shaft 52 while the second reclaim container 65 constituting part of the powder container device 6A is reclaiming the toner 8A.

Thus, the leveling member 53 keeps rotating in the direction of arrow C substantially about the rotation shaft 52. After the toner 8A reclaimed by the second cleaning device 36 is transported to the second reclaim container 65 through the second reclaim transporter 37, the toner 8A falls down through the reclaim port 66*b* in the connection portion 66 to be discharged to and accommodated in the second reclaim container 65.

As illustrated in FIG. 5A, when the toner 8A accommodated in the second reclaim container 65 accumulates immediately below the reclaim port 66*b* in an arc form, a portion of the free end 53*b* in the rotating leveling member 53 in the powder leveler 5A comes into contact with and moves part of the accumulated toner 8A to level out part of the accumulated toner 8A.

The leveling member 53 rotates while coming into contact with the protruding portion 54A and the connection portion 66 serving as obstacles.

Figure 7A:
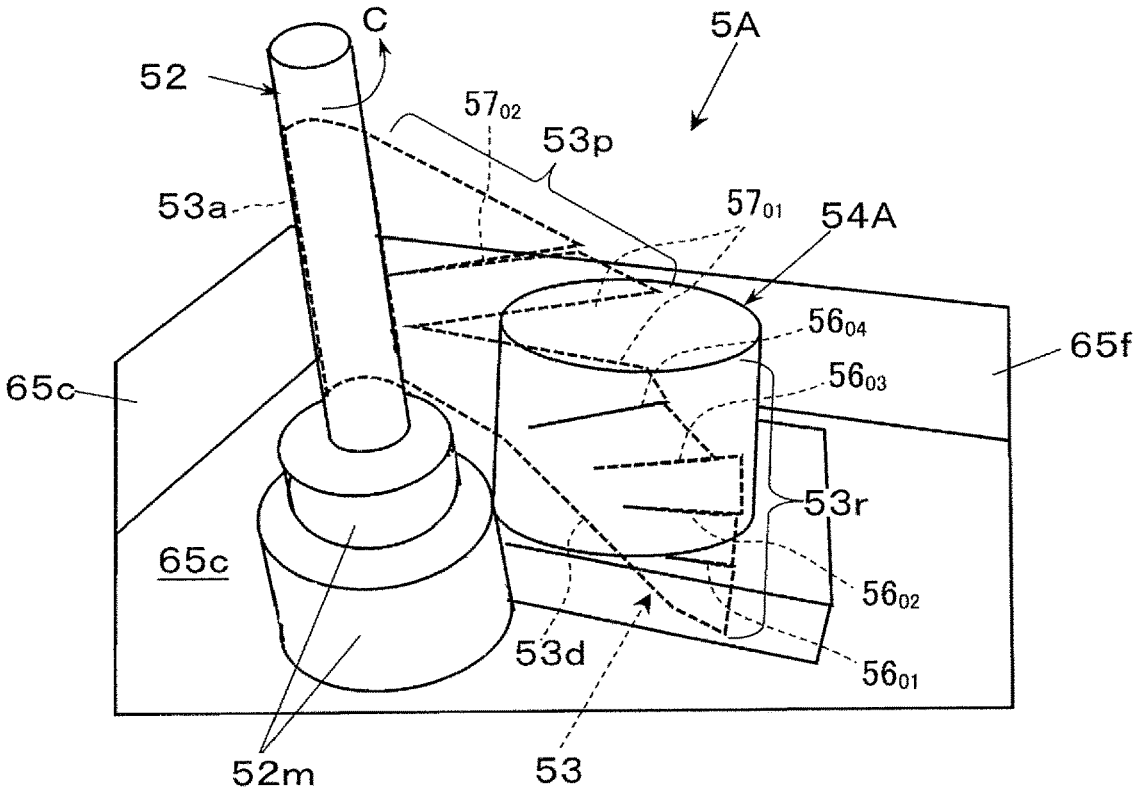
FIG. 7A is a schematic perspective view of the leveling member in the powder leveler illustrated in FIG. 4 when coming into contact with an obstacle after rotation.

When the leveling member 53 starts coming into contact with the protruding portion 54A serving as an obstacle, as illustrated in FIG. 7A, a portion 53*p* in the leveling member 53 that does not come into contact with the protruding portion 54A is separated from a portion 53*r* in the leveling member 53 that comes into contact with the protruding portion 54A with respect to the second discontinuous portions 57.

Specifically, in the leveling member 53 at this time, the portion 53*r* that is in contact with the protruding portion 54A starts being bent backward (upstream side) in the rotation direction C, whereas the portion 53*p* that does not come into contact with the protruding portion 54A passes by the protruding portion 54A without coming into contact with the protruding portion 54A and without being bent.

Thus, the portion 53*p* in the leveling member 53 that does not come into contact with the protruding portion 54A is not bent while passing by the protruding portion 54A serving as an obstacle. The portion 53*p* that does not come into contact with the protruding portion 54A thus does not exhibit behaviors such as being restored or released from being bent.

Figure 7B:
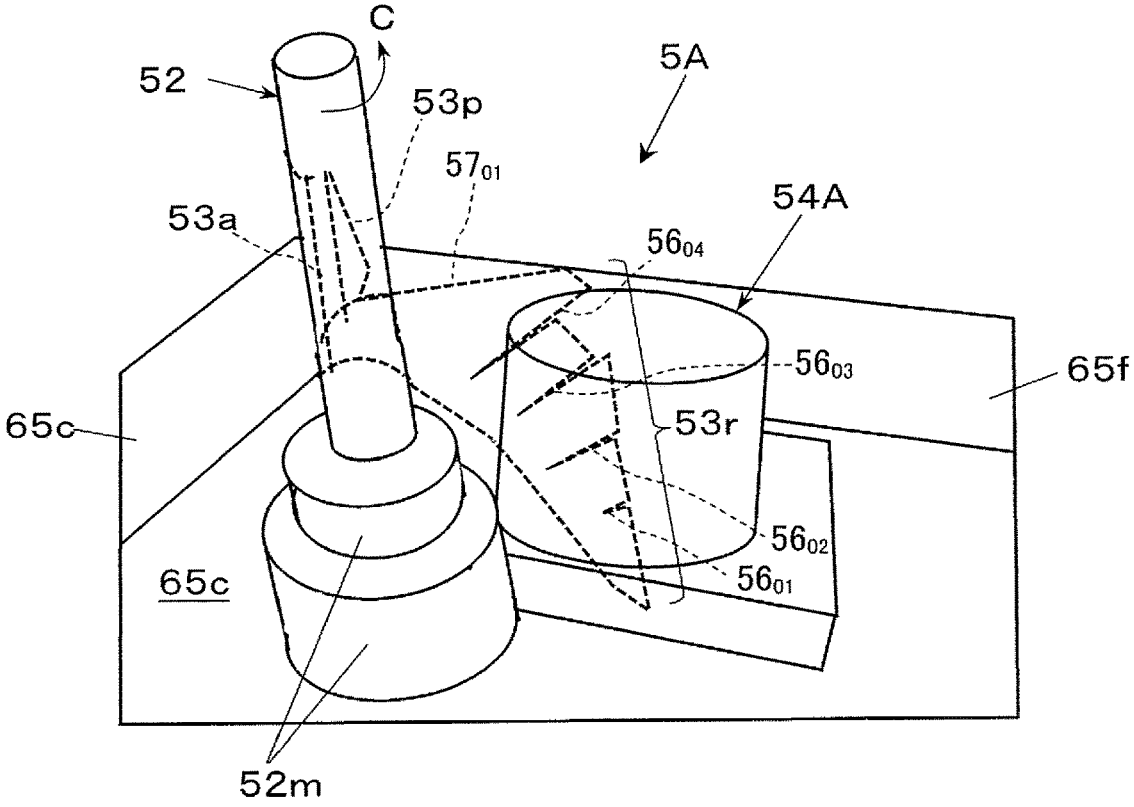
FIG. 7B is a schematic perspective view of the leveling member in FIG. 7A rotated further.

Subsequently, when the leveling member 53 passes by the protruding portion 54A serving as an obstacle while coming into contact with the protruding portion 54A, as illustrated in FIG. 7B, in the portion 53*r* of the leveling member 53 that comes into contact with the protruding portion 54A, the strips divided at the four first discontinuous portions 56 are individually bent while being slightly separated from each other, and move while being elastically deformed. When the portion 53*r* of the leveling member 53 that comes into contact with the protruding portion 54A passes by the protruding portion 54A, the strips divided at the four first discontinuous portions 56 are sequentially released from being bent step by step.

Thus, immediately after the portion 53*r* of the leveling member 53 that comes into contact with the protruding portion 54A serving as an obstacle passes by the protruding portion 54A, the bent strips divided at the four first discontinuous portions 56 are sequentially released step by step to be restored. FIG. 7B illustrates a state before the portion of the leveling member 53 defined by the first discontinuous portion $\mathbf{56}_{04}$ and the second discontinuous portion $\mathbf{57}_{01}$ firstly passes by the protruding portion 54A to be released.

The strips divided at the first discontinuous portions 56 in the leveling member 53 accumulate lower energy (restoring force) when being bent than that accumulated by the first discontinuous portion 56 not divided into strips.

After passing by the protruding portion 54A, the rotating leveling member 53 rotates while coming into contact with the connection portion 66 serving as an obstacle.

When the leveling member 53 starts coming into contact with the connection portion 66, in the portion 53*p* of the leveling member 53 that does not come into contact with the protruding portion 54A, a portion between the second discontinuous portion $\mathbf{57}_{01}$ and the first discontinuous portion $\mathbf{56}_{04}$ that is located a relatively long distance away from the rotation shaft 52 in the radial direction comes into contact with and passes by the connection portion 66. Here, the portion that does not come into contact with the connection portion 66 (portion above the second discontinuous portions $\mathbf{57}_{02}$ in FIG. 7) and the portion that comes into contact with the connection portion 66 (portion between the second discontinuous portion $\mathbf{57}_{01}$ and the first discontinuous portion $\mathbf{56}_{04}$) are separated from each other with respect to the second discontinuous portions $\mathbf{57}_{02}$.

Here, in the leveling member 53, the portion that does not come into contact with the connection portion 66 is not bent while passing by the connection portion 66. Thus, the portion that does not come into contact with the connection portion 66 does not exhibit behaviors such as being restored or released from being bent.

On the other hand, in the leveling member 53, the portion that comes into contact with the connection portion 66 is bent by coming into contact with the connection portion 66, and then released after passing by the connection portion 66. The portion 53*p* that does not come into contact with the protruding portion 54A is divided (into two pieces) by the second discontinuous portions 57 (actually, the second discontinuous portion $\mathbf{57}_{02}$). Thus, the portion that comes into contact with the connection portion 66 accumulates lower energy (restoring force) when being bent, and thus is restored with weak force after being released.

Subsequently, the portion 53*r* of the leveling member 53 that comes into contact with the protruding portion 54A comes into contact with and passes by the connection portion 66.

Substantially similarly to the case where the portion 53*r* of the leveling member 53 that comes into contact with the protruding portion 54A passes by the protruding portion 54A while being in contact with the protruding portion 54A, when the portion 53*r* of the leveling member 53 passes by the connection portion 66, the strips divided at the four first discontinuous portions 56 are sequentially released from being bent step by step.

As described above, the leveling member 53 in the powder leveler 5A makes one rotation while coming into contact with the protruding portion 54A and the connection portion 66 serving as obstacles, and repeats the rotations to keep leveling out the accumulating toner 8A.

In the powder leveler 5A, when coming into contact with the protruding portion 54A and the connection portion 66 serving as obstacles on the rotation path, a portion of the leveling member 53 passes by the protruding portion 54A and the connection portion 66 while being bent, and is then released. Here, the multiple first discontinuous portions 56 and the second discontinuous portions 57 are released at different timings between the portions of the leveling member 53, and thus the leveling member 53 as a whole is gradually released step by step.

Thus, in the powder leveler 5A, sounds caused when portions of the leveling member 53 are released from the protruding portion 54A and the connection portion 66 after passing by the protruding portion 54A and the connection portion 66 vary in time. In the powder leveler 5A, timings when portions of the leveling member 53 are released from the protruding portion 54A and the connection portion 66 after passing by the protruding portion 54A and the connection portion 66 vary, so that the sounds caused at the portions released at different timings are muffled.

In the powder leveler 5A, compared to a structure where the four first discontinuous portions 56 are not equidistantly arranged, portions of the leveling member 53 bent by coming into contact with the protruding portion 54A and the connection portion 66 serving as obstacles are released, at regularly different and smoothly varying timings, from the protruding portion 54A and the connection portion 66 after passing by the protruding portion 54A and the connection portion 66, to cause sounds at different timings.

In the powder leveler 5A, compared to a structure where the terminal ends 56*e* of the first discontinuous portions 56 are not located on the straight line F obliquely crossing the axis J of the rotation shaft 52, sounds caused when the leveling member 53 is released after coming into contact with and passing by the protruding portion 54A and the connection portion 66 serving as obstacles while being bent are uniformly muffled with the force exerted when the leveling member 53 is released being substantially similarly reduced.

Compared to a structure where the leveling member 53 does not have the second discontinuous portions 57, in the powder leveler 5A, the portion of the leveling member 53 that is bent by coming into contact with the protruding portion 54A and the connection portion 66 serving as obstacles is reduced. Thus, the sounds caused when the leveling member 53 is released after passing by the obstacles while being bent is reduced as a whole.

Compared to a structure where the terminal ends 57*e* of the second discontinuous portions 57 are not located at positions close to the rotation shaft 52, the portion 53*p* of the leveling member 53 in the powder leveler 5A that does not come into contact with the protruding portion 54A and the connection portion 66 serving as obstacles has a lower ratio of a portion continuous with the first end 53*a* attached to the rotation shaft 52 (width of the connection portion 53*g* illustrated in the lower portion in FIG. 6), and passes by the obstacles without being bent. Thus, the sounds caused when the leveling member 53 is released are muffled as a whole.

In the powder leveler 5A, compared to a structure where the second discontinuous portions 57 is not located closer to the protruding portion 54A serving as an obstacle, the portion of the leveling member 53 that is bent while passing by the obstacle is reduced, and the sounds caused when the leveling member 53 is released are also muffled as a whole.

In the powder leveler 5A, compared to a structure where the leveling member 53 does not have a shape (such as a parallelogram or a trapezoid) having a portion located on the outer side of the first end 53*a* in the direction of the axis J of the rotation shaft 52, the leveling member 53 is more easily bent by coming into contact with and passing by the protruding portion 54A and the connection portion 66 serving as obstacles, and sounds caused when part of the leveling member 53 is released after coming into contact with and passing by the obstacles while being bent vary in time.

Compared to a structure where the first discontinuous portions 56 are not disposed in a portion located on the outer side of the leveling member 53 in the direction of the axis J of the rotation shaft 52, the leveling member 53 in the powder leveler 5A is more easily bent by coming into contact with and passing by the protruding portion 54A and the connection portion 66 serving as obstacles, and sounds caused when part of the leveling member 53 is released after coming into contact with and passing by the obstacles while being bent vary in time.

Second Exemplary Embodiment

Figure 8:
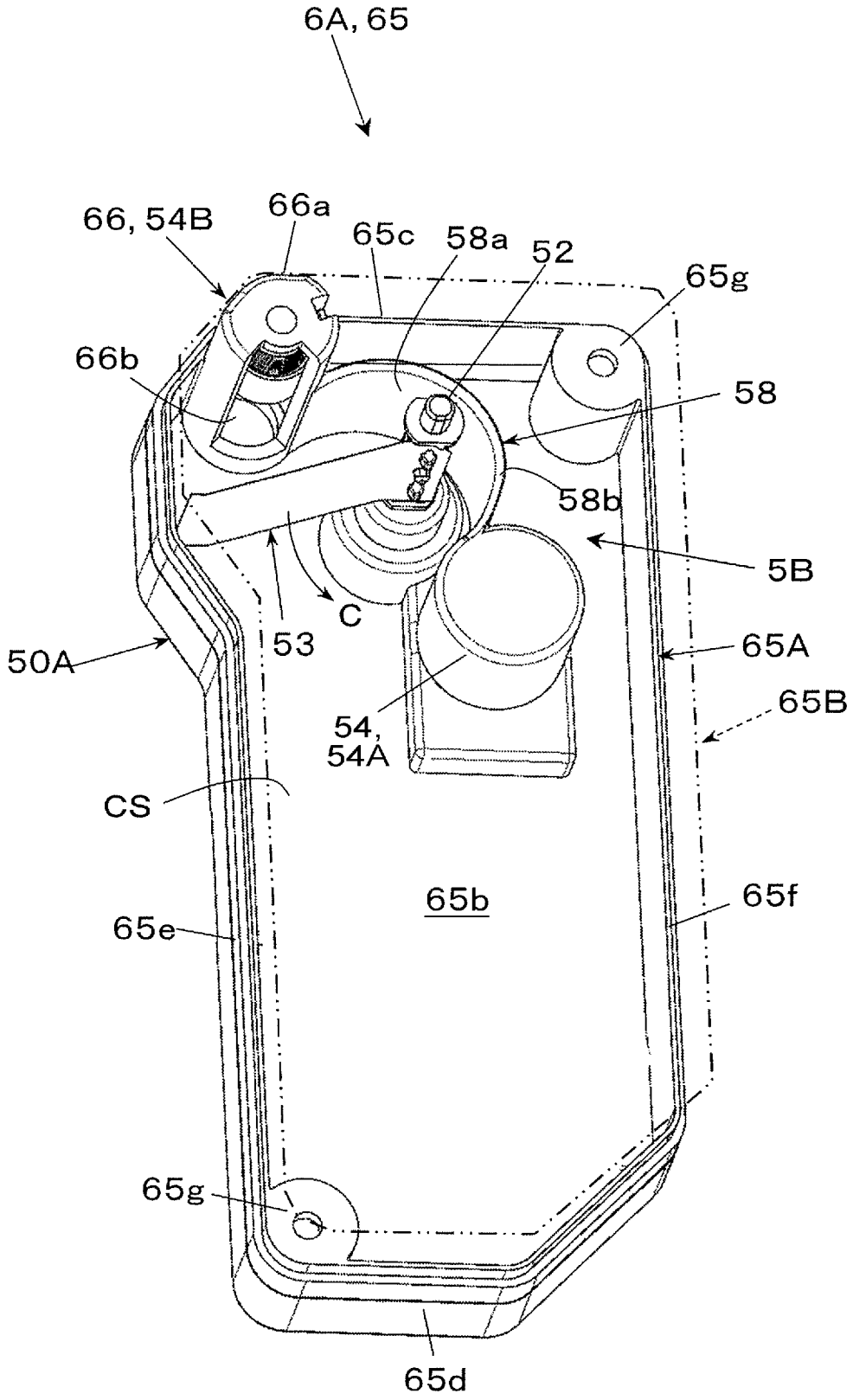
FIG. 8 is a perspective view of a half of a disassembled container structure in a powder container device including a powder leveler according to a second exemplary embodiment.

FIG. 8 illustrates a powder container device 6A including a powder leveler 5B according to a second exemplary embodiment of the present disclosure.

The powder container device 6A has the same structure as the powder container device 6A according to the first exemplary embodiment except that the powder container device 6A according to the second exemplary embodiment includes a powder leveler 5B formed by adding a release adjusting member 58 to the powder leveler 5A according to the first exemplary embodiment.

At a portion of the second reclaim container 65 of the container structure located downstream of the protruding portion 54A serving as an obstacle in the rotation direction C of the leveling member 53, the release adjusting member 58 supports the bent portions of the leveling member 53, bent as a result of passing by the protruding portion 54A serving as an obstacle, to sequentially release the portions divided at the first discontinuous portions 56.

As illustrated in FIG. 8 or 9, the release adjusting member 58 includes a plate body 58*a*, a support portion 58*b* that supports the end portion of the body 58*a* opposite to the side wall 65*b*, a starting end 58*c* that is an end portion of the release adjusting member 58 located upstream in the rotation direction C, and a terminal end 58*d* that is an end portion of the release adjusting member 58 located downstream in the rotation direction C. The support portion 58*b* supports a portion of the leveling member 53 bent when being released.

The release adjusting member 58 according to the second exemplary embodiment is disposed between the protruding portion 54A, serving as an obstacle, and the connection portion 66 located downstream from the protruding portion 54A in the rotation direction C. The release adjusting member 58 is formed from a bent plate member. The release adjusting member 58 is formed from a material such as acrylonitrile-butadiene-styrene resin (ABS).

Figure 9A:
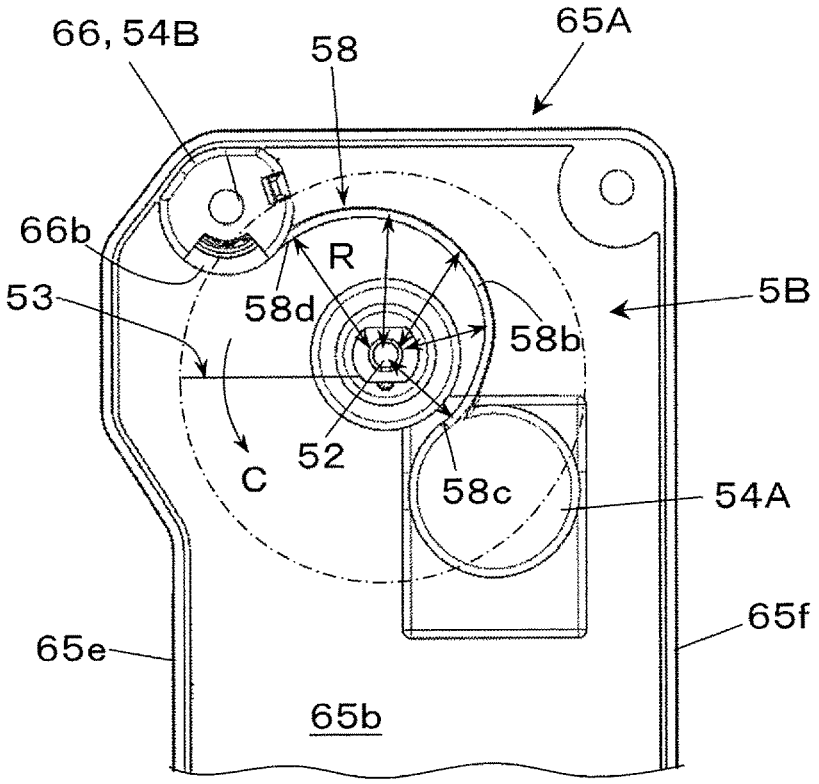
FIG. 9A is a schematic view of a structure of the powder leveler illustrated in FIG. 8.

As illustrated in FIGS. 8 and 9, the release adjusting member 58 according to the second exemplary embodiment has a portion (support portion 58*b*) that supports the bent portion of the leveling member 53. The support portion 58*b* is disposed to gradually increase a distance R between itself and the rotation shaft 52 toward the downstream side in the rotation direction C of the leveling member 53. The distance R indicated with double-pointed arrows in FIG. 9A gradually increases by a predetermined ratio from the starting end 58*c* of the release adjusting member 58 toward the terminal end 58*d* on the downstream side in the rotation direction C. The distance R is determined, for example, in the following manner. Firstly, for example, the minimum distance at the starting end 58*c* of the release adjusting member 58 is determined to be larger than or equal to 3 mm, since the support portion 58*b* has to have at least such a dimension as to be capable of supporting the portion of the leveling member 53 bent when passing by an obstacle. For example, the maximum distance at the terminal end 58*d* of the release adjusting member 58 is determined to be smaller than or equal to 30 mm, since the distance has to be at least shorter than a dimension from the end 53*a* of the leveling member 53 attached to the rotation shaft to the free end 53*b*. The support portion 58*b* of the release adjusting member 58 may increase the distance R stepwise.

The height of the support portion 58*b* in the release adjusting member 58 (dimension protruding inward from the side wall 65*b*) is the same throughout from the starting end 58*c* to the terminal end 58*d*. The height is the same as or smaller than the height (distance by which it is spaced inward from the side wall 65*b*) of the protruding portion 54A serving as an obstacle at which the starting end 58*c* is disposed.

Thus, the support portion 58*b* in the release adjusting member 58 has a shape of a curved end with a variable radius that increases gradually.

The powder container device 6A including the powder leveler 5B including the release adjusting member 58 operates similarly to the powder container device 6A according to the first exemplary embodiment, and has substantially the same effects from the operation except that the leveling member 53 of the powder leveler 5B operates in the following manner and has the following effects.

Figure 9B:
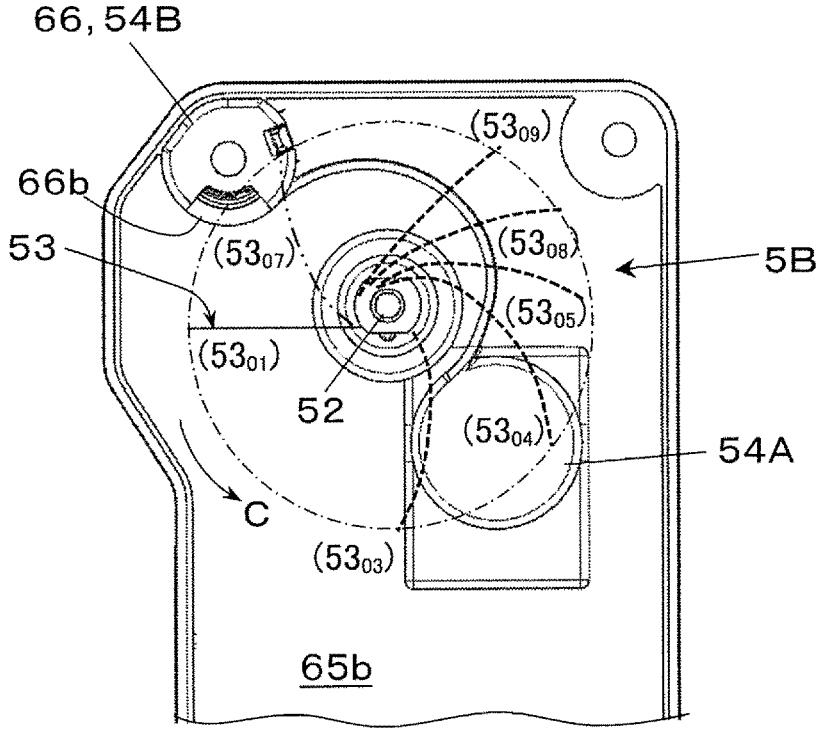
FIG. 9B is a schematic view of the powder leveler illustrated in FIG. 9A in operation.

As illustrated in FIG. 9B, in the powder leveler 5B, the portion 53*r* of the leveling member 53 rotates in the direction of arrow C and comes into contact with the protruding portion 54A serving as an obstacle. Thus, the four strips divided at the first discontinuous portions 56 move while being slightly separated from each other and individually bent to be elastically deformed. Then, the four strips are to be released from being bent stepwise when passing by the protruding portion 54A. The leveling member 53 here is the leveling member 53 denoted with reference signs $\mathbf{53}_{03}$ and $\mathbf{53}_{04}$ in FIG. 9B.

In the powder leveler 5B, the release adjusting member 58 is disposed between the protruding portion 54A serving as an obstacle to the connection portion 66, which is the following obstacle downstream in the rotation direction C. Thus, as illustrated in FIGS. 9B and 10B, the portion 53*r* of the leveling member 53 that is in contact with the protruding portion 54A is kept being supported by the support portion 58*b* of the release adjusting member 58 while retaining the height substantially the same as the height of the protruding portion 54A. Here, a portion of the second adjacent end 53*d* in the portion 53*r* of the leveling member 53 that is in contact with the protruding portion 54A is also kept being supported by the support portion 58*b* of the release adjusting member 58. The leveling member 53 denoted with reference signs $\mathbf{53}_{05}$, $\mathbf{53}_{08}$, and $\mathbf{53}_{09}$ in FIG. 9B indicates the states while being supported by the support portion 58*b* of the release adjusting member 58.

Thus, the portion 53*r* bent by coming into contact with the protruding portion 54A is somewhat retained as being bent without being completely released and restored until arriving at the next connection portion 66. Strictly, the portion 53*r* bent by coming into contact with the protruding portion 54A is gently released as it passes by the support portion 58*b* of the release adjusting member 58, which is a curve with a variable radius that increases gradually, downstream in the rotation direction C, and starts being restored gradually.

Thus, the leveling member 53 is not completely released from being bent and restored when it passes by the protruding portion 54A serving as an obstacle, and reduces sounds caused when being released.

Figure 10A:
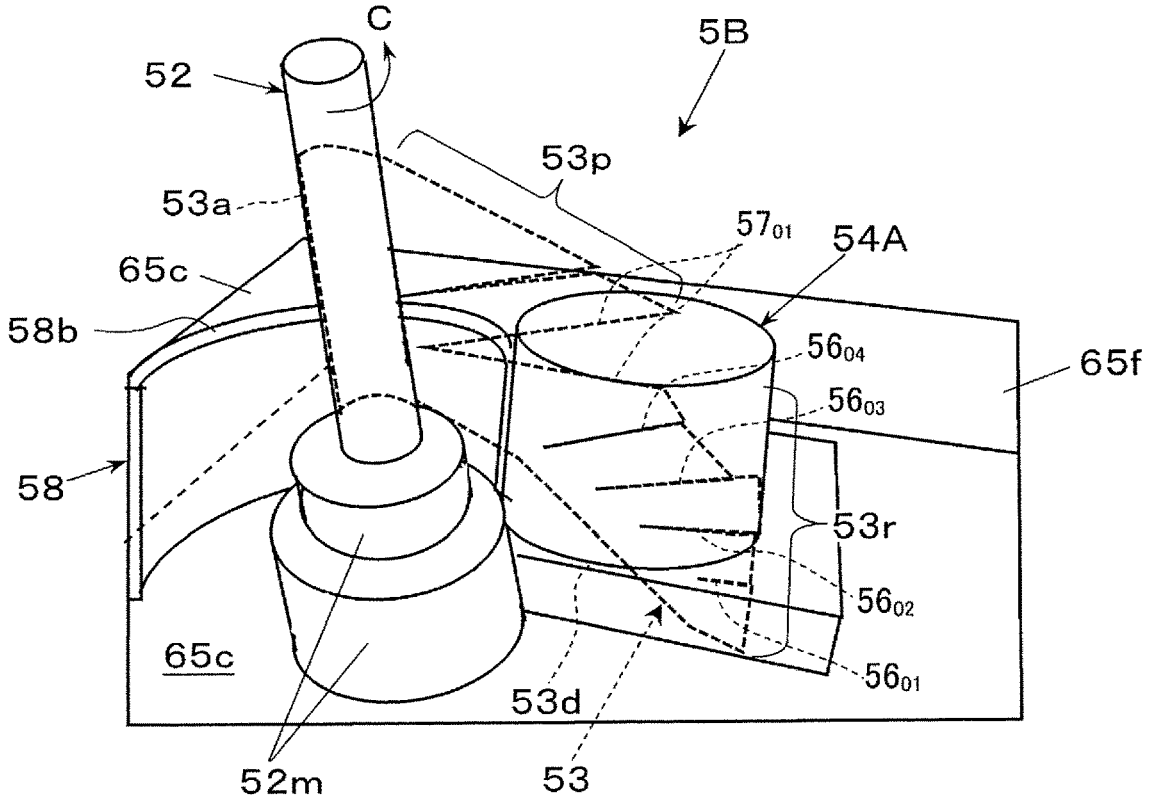
FIG. 10A is a schematic perspective view of a leveling member in the powder leveler illustrated in FIG. 8 when coming into contact with an obstacle after rotation.
Figure 10B:
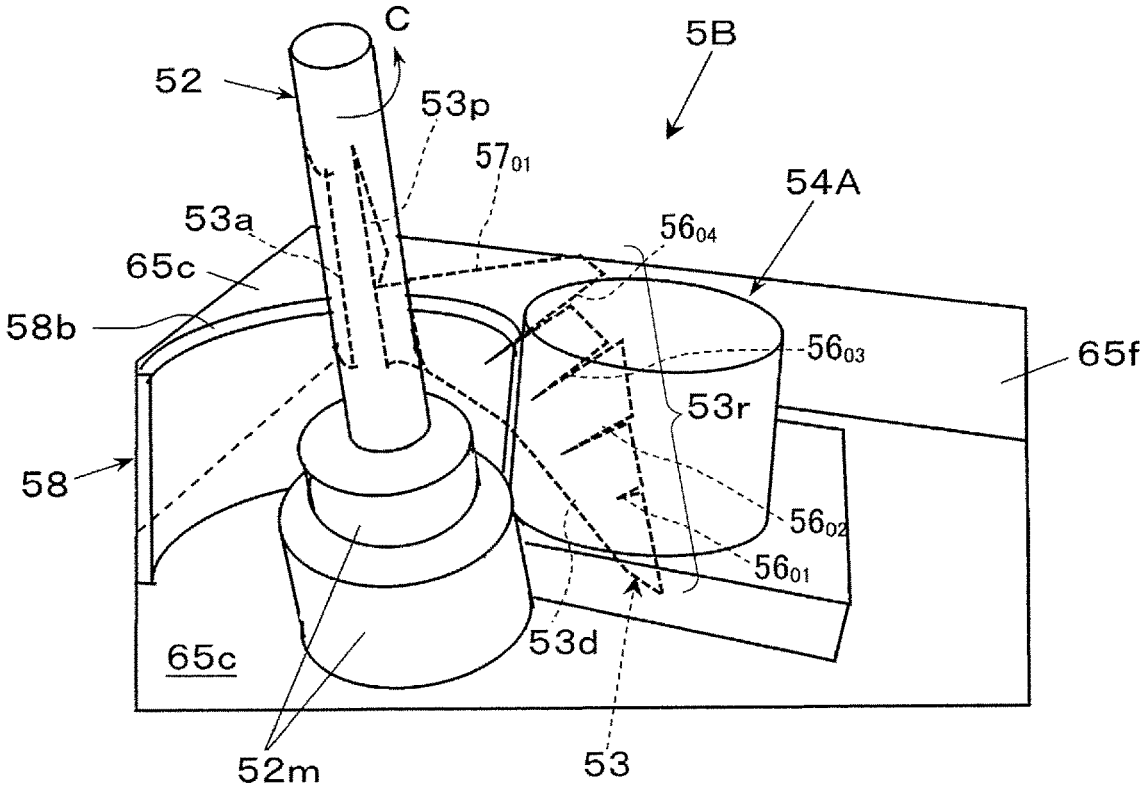
FIG. 10B is a schematic perspective view of the leveling member in FIG. 10A when rotated further.

As in the case of the first exemplary embodiment, the portion 53*p* of the leveling member 53 that does not come into contact with the protruding portion 54A is separated, with the second discontinuous portions 57, from the portion 53*r* that comes into contact with the protruding portion 54A, as illustrated in FIG. 10A. Thus, the portion 53*p* passes by the protruding portion 54A without being bent as a result of coming into contact with the protruding portion 54A.

In the powder leveler 5B, the leveling member 53 then passes by the connection portion 66 serving as an obstacle. Here, the portion 53*r* of the leveling member 53 that is in contact with the protruding portion 54A is bent by coming into contact with the connection portion 66. As in the case of the first exemplary embodiment, when being bent and passing by the connection portion 66, portions of the contact portion 53*r* divided at the four first discontinuous portions 56 are released stepwise.

As in the case of the first exemplary embodiment, the portion 53*p* of the leveling member 53 that does not come into contact with the protruding portion 54A passes while being partially bent by coming into contact with the connection portion 66.

Thus, in the powder leveler 5B, the portion of the leveling member 53 bent as a result of being supported by the release adjusting member 58 after passing by the protruding portion 54A serving as an obstacle is retained without being completely released. Thus, compared to a structure not including the release adjusting member 58, the sounds caused when the powder leveler 5B is released after coming into contact with and passing by the protruding portion 54A and the connection portion 66 serving as obstacles while being bent are muffled when passing by the protruding portion 54A.

Modification Example of Second Exemplary Embodiment

In the second exemplary embodiment, as an example of the release adjusting member 58 in the powder leveler 5B, a release adjusting member including a support portion 58*b* that supports a bent portion of the leveling member 53 may have a height in the direction of the axis J of the rotation shaft 52 that decreases on a side downstream of the protruding portion 54A serving as an obstacle in the direction in which the bent portion passes.

Here, preferably, the support portion 58*b* of the release adjusting member 58 gradually decreases its height toward downstream in the rotation direction C. Instead, the height may decrease stepwise toward downstream in the rotation direction C.

The second exemplary embodiment has described an example structure where the release adjusting member 58 is disposed between the protruding portion 54A and the connection portion 66 (or 54B) serving as two obstacles. However, the release adjusting member 58 may be disposed downstream of the connection portion 66 serving as an obstacle in the rotation direction C, or disposed between the protruding portion 54A and a position in front of the connection portion 66 (before arriving at the connection portion 66).

When the structure includes a single obstacle, the release adjusting member 58 is disposed downstream of the obstacle in the rotation direction C.

Third Exemplary Embodiment

Figure 11:
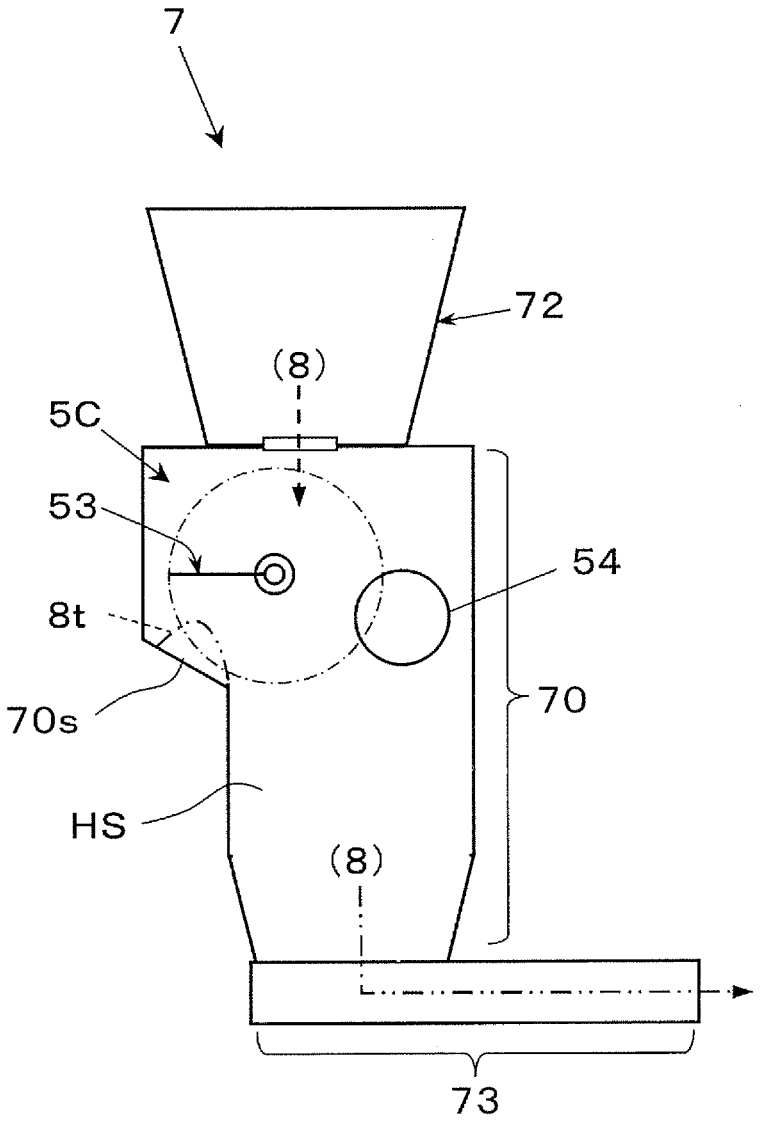
FIG. 11 is a schematic view of a powder transporter according to a third exemplary embodiment.

FIG. 11 illustrates a powder transporter 7 according to a third exemplary embodiment.

As illustrated in FIG. 11, the powder transporter 7 includes a transport path structure 70 that includes a transport space HS to which the powder 8 falls and is transported, a powder leveler 5C that includes a sheet-shaped leveling member 53, and an obstacle 54 disposed in the transport path structure 70 at such a position as to obstruct part of the rotation path of the leveling member 53. The leveling member 53 rotates while having a first end 53*a* attached to a rotation shaft 52 disposed inside the transport path structure 70, and comes into contact with part of the powder 8 accumulating at a position closer to a free end 53*b*, located farther from the rotation shaft 52, to level out the powder 8. When brought into contact with part of the rotating leveling member 53, the obstacle 54 allows the rotating leveling member 53 to pass thereby while the rotating leveling member 53 is bent.

The transport path structure 70 forms part of the path along which the powder 8 is transported, and may have any shape or structure. The transport path structure 70 according to the third exemplary embodiment is connected, at its upper portion, to a powder feeder 72 that feeds powder, and, at its lower portion, to a transport path 73 along which the powder 8 is transported to a destination. Thus, the powder transporter 7 is used as a relay device located between the powder feeder 72 and the transport path 73 to transport the powder 8.

For example, as illustrated in FIG. 11, the transport path structure 70 includes an inclined inner wall 70*s*. The powder transporter 7 levels out (moves for removal) powder 8*t* accumulating on the inclined inner wall 70*s* with a leveling member 53 in the powder leveler 5C.

The powder transporter 7 includes, as the powder leveler 5C, a powder leveler that includes multiple first discontinuous portions 56 in at least the range E where the rotation path for the leveling member 53 is obstructed by the protruding portion 54A and the connection portion 66 serving as obstacles. The multiple first discontinuous portions 56 extend inward from the end closer to the free end 53*b* in a direction D obliquely crossing the axis J of the rotation shaft 52, and have terminal ends 56*e* located within the range E. Specifically, the powder leveler 5C is partially or entirely formed based on the powder levelers 5A and 5B according to the first and second exemplary embodiments.

The powder transporter 7 may include part or entirety of the replenishment transporter 27 according to the first exemplary embodiment, if the powder transporter 7 is to include the powder leveler 5A or 5B in the replenishment transporter 27 that performs toner replenishment according to the first or second exemplary embodiment.

Compared to a structure where, for example, the multiple first discontinuous portions 56 according to the first exemplary embodiment are not disposed in the range (E) where at least part of the rotation path for the leveling member 53 in the powder leveler 5C is obstructed by the obstacles 54 located on part of the rotation path, the sounds caused in the powder transporter 7 including the powder leveler 5C when part of the leveling member 53 is released after coming into contact with and passing by the obstacles 54 while being bent vary in time. Thus, the sounds caused during transportation of the powder 8 are reduced.

Fourth Exemplary Embodiment

Figure 12:
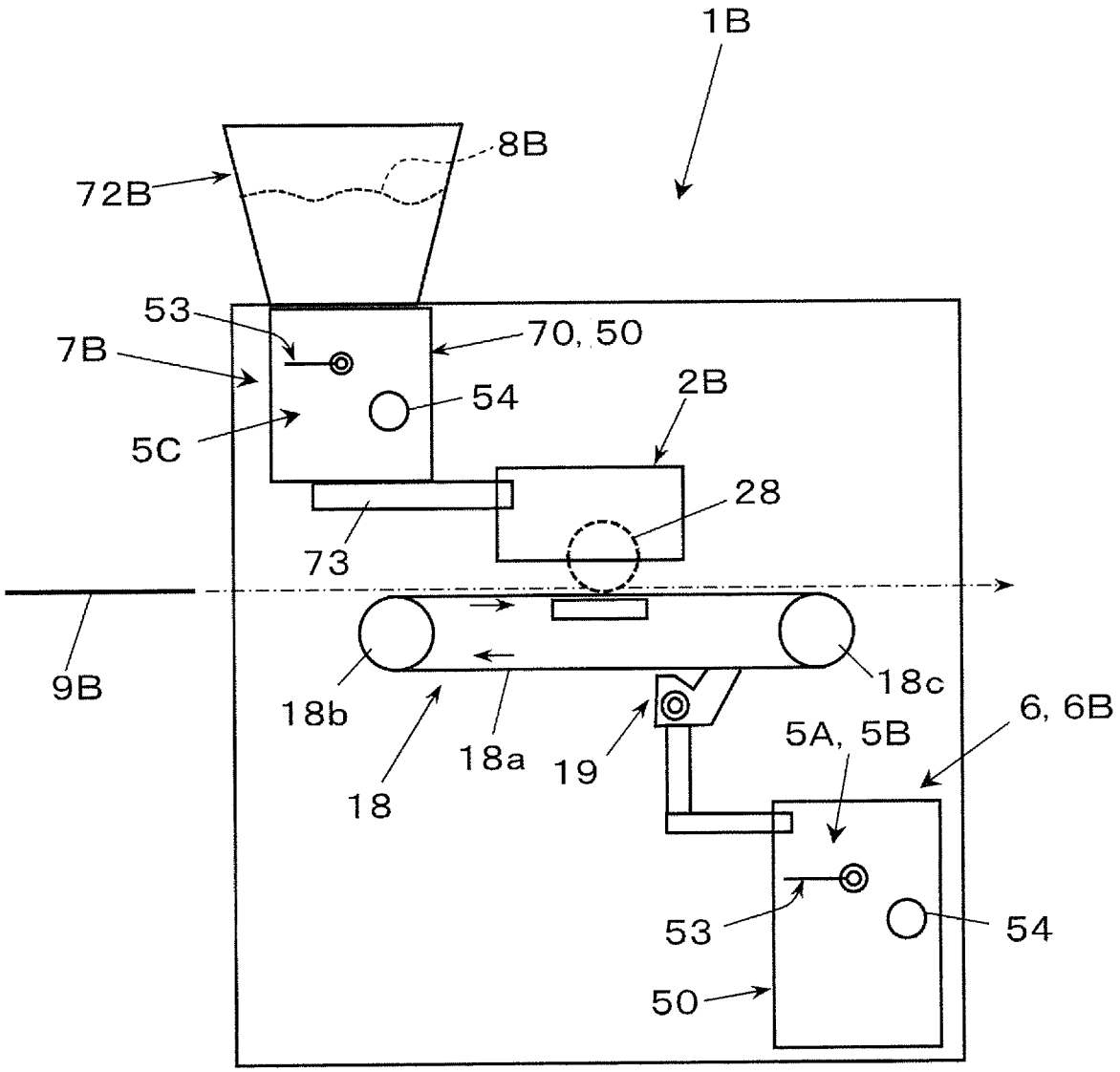
FIG. 12 is a schematic view of a powder coating device, which is another example of a powder handling device according to a fourth exemplary embodiment, a powder transporter, and a powder container device included in the powder coating device.

FIG. 12 illustrates a powder coating device 1B, which is another example of the powder handling device 1 according to a fourth exemplary embodiment.

As illustrated in FIG. 12, the powder coating device 1B includes a powder application device 2B, which is another example of the powder applicator 2 that applies powder paint 8B to a to-be-coated sheet 9B, a powder-paint transporting device 7B that transports the powder paint 8B to the powder application device 2B, and a transporting device 18 that transports the to-be-coated sheet 9B to the powder application device 2B. The powder paint 8B is another example of powder. The to-be-coated sheet 9B is another example of a powder-receiving object 9.

For example, the powder application device 2B electrostatically applies the powder paint 8B to the to-be-coated sheet 9B with, for example, an application roller 28. Examples of the to-be-coated sheet 9B include a metal sheet.

The transporting device 18 may be any device capable of transporting the to-be-coated sheet 9B to the powder application device 2B. For example, the transporting device 18 may be a belt conveyer that transports the to-be-coated sheet 9B while holding the to-be-coated sheet 9B on an endless belt 18*a* that rotates while being supported by multiple support rollers 18*b* and 18*c*. The transporting device 18 includes a third cleaning device 19 that removes the powder paint 8B left on the outer peripheral surface of the endless belt 18*a* to clean the outer peripheral surface. The third cleaning device 19 may be, for example, the second cleaning device 36 according to the first exemplary embodiment.

A container portion 72B in FIG. 12 accommodates the powder paint 8B for replenishment. The container portion 72B is formed from, for example, a fixed containing hopper or a removable replaceable container.

As an example of the powder-paint transporting device 7B, the powder transporter 7 according to the third exemplary embodiment is used. Specifically, the powder-paint transporting device 7B includes the powder leveler 5C. The powder leveler 5C is used to level out the powder paint accumulating in the transport path structure 70 of the powder-paint transporting device 7B.

The powder coating device 1B includes the powder-paint transporting device 7B including the powder leveler 5C. Thus, compared to a structure where, for example, the multiple first discontinuous portions 56 according to the first exemplary embodiment are not disposed in the range (E) where at least part of the rotation path for the leveling member 53 in the powder leveler 5C is obstructed by the obstacles 54 located on part of the rotation path, the sounds caused when part of the leveling member 53 is released after coming into contact with and passing by the obstacles 54 while being bent vary in time. Thus, the sounds caused during transportation of the powder paint 8B is reduced.

The powder coating device 1B includes a powder paint container device 6B, which is another example of a powder container device 6 that accommodates the powder paint 8B reclaimed by the third cleaning device 19 of the transporting device 18 or the powder application device 2B. The powder paint container device 6B is formed based on, for example, part or entirety of the powder container device 6A according to the first or second exemplary embodiment. Specifically, the powder paint container device 6B is formed as a container device including the powder leveler 5A or 5B.

Thus, the powder coating device 1B includes the powder-paint transporting device 7B including the powder leveler 5A or 5B. Thus, the sounds caused when part of the leveling member 53 in the powder leveler 5A or 5B is released after coming into contact with and passing by the obstacles 54 while being bent vary in time. Thus, the sounds caused during reclaim of the powder paint 8B is reduced.

Other Modification Examples

In the first, second, and other exemplary embodiments, a parallelogrammatic sheet member has been described as an example of the leveling member 53 in the powder leveler 5A or 5B. The leveling member 53 is not limited to this example, and may be, for example a leveling member 53B formed from a trapezoidal sheet member, as illustrated in FIG. 13.

Figure 13:
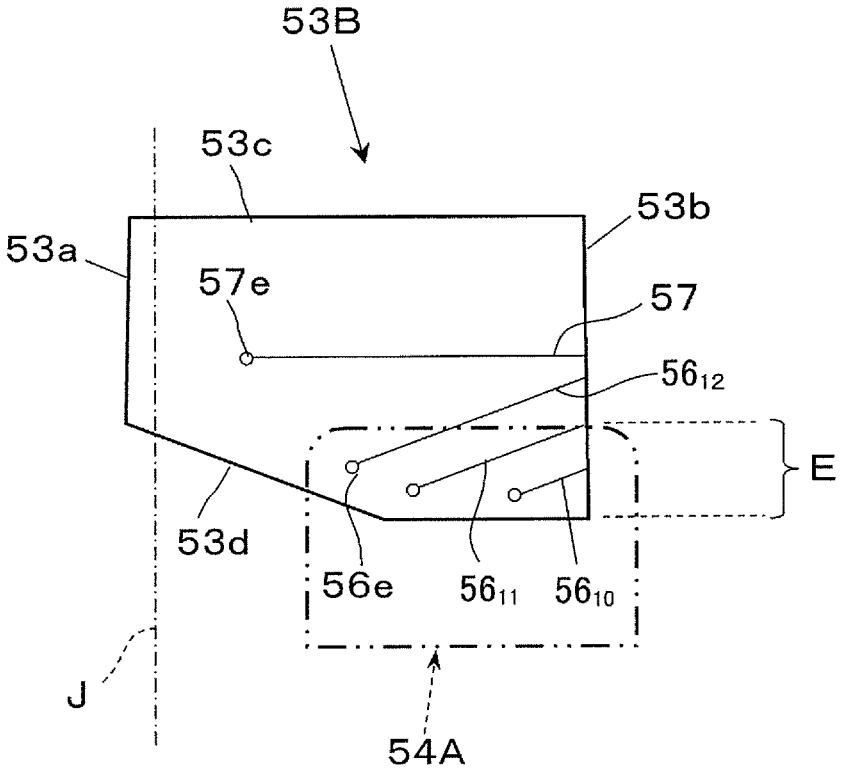
FIG. 13 is a diagram illustrating another structure of a leveling member.

The leveling member 53B illustrated in FIG. 13 by way of example includes multiple (three) first discontinuous portions 56 ($\mathbf{56}_{10}$, $\mathbf{56}_{11}$, and $\mathbf{56}_{12}$) that extend inward from the end close to the free end 53*b* in the direction obliquely crossing the axis J of the rotation shaft. The first discontinuous portions 56 have terminal ends 56*e* located in the range E where the rotation path for the leveling member 53B is obstructed by the obstacles 54. The leveling member 53B also includes one second discontinuous portion 57.

In the first, second, and other exemplary embodiments, cuts are described as examples of the first discontinuous portions 56 and the second discontinuous portions 57 of the leveling member 53. Instead, the first discontinuous portions 56 and the second discontinuous portions 57 may be slits with a predetermined width. The first discontinuous portions 56 and the second discontinuous portions 57 may be an appropriate combination of cuts and slits. The number of the first discontinuous portions 56 and the number of the second discontinuous portions 57 are not limited to particular ones.

The multiple first discontinuous portions 56 in the leveling member 53 or 53B may be also referred to as discontinuous portions formed in the range E and extending from the inner side of the range E to the free end 53*b* in the direction D obliquely crossing the axis J of the rotation shaft 52. In the range E, at least the rotation path for the leveling member 53 or 53B is obstructed by the obstacles 54.

The first, second, and other exemplary embodiments each include two obstacles 54 in the powder leveler 5A or 5B by way of example. However, the powder leveler may have one obstacle 54 or three or more obstacles 54.

The first and second exemplary embodiments have described the image forming apparatus 1A including four image forming members 2A, as an example of the powder handling device 1. However, the image forming apparatus 1A may include one image forming member 2A, or three, five, or more image forming members 2A. Instead, a direct transfer image forming apparatus may be used as the image forming apparatus 1A.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A powder leveler, comprising:

a structure having an internal space in which powder moves;

a sheet-shaped leveling member that rotates while having a first end thereof attached to a rotation shaft disposed inside the structure, and that comes into contact with part of the powder accumulating at a portion inside the structure close to a free end thereof located away from the rotation shaft to level out the powder; and an obstacle located inside the structure at a position on a rotation path of the leveling member to obstruct the rotation path, the obstacle allowing the leveling member to pass thereby while the leveling member is rotating and being bent as a result of partially coming into contact with the obstacle, wherein the leveling member includes a plurality of first discontinuous portions in at least a range in which the rotation path is obstructed by the obstacle while the leveling member is rotating, the plurality of first discontinuous portions extend inward from an end closer to the free end in a direction obliquely crossing an axis of the rotation shaft, and the first discontinuous portions have terminal ends located within the range, wherein the sheet-shaped leveling member does not contact a bottom wall in a gravity direction defining the internal space.

2. The powder leveler according to claim 1, wherein the first discontinuous portions are equidistantly arranged.

3. The powder leveler according to claim 2, wherein the terminal ends of the first discontinuous portions are aligned on a single straight line obliquely crossing the axis of the rotation shaft.

4. The powder leveler according to claim 3, further comprising:

a release adjusting member at a portion in the structure downstream of the obstacle in a rotation direction of the leveling member, the release adjusting member supporting the leveling member by sequentially releasing divided portions of a bent portion of the leveling member bent after passing by the obstacle, the divided portions being divided by the first discontinuous portions.

5. The powder leveler according to claim 2, further comprising:

a release adjusting member at a portion in the structure downstream of the obstacle in a rotation direction of the leveling member, the release adjusting member supporting the leveling member by sequentially releasing divided portions of a bent portion of the leveling member bent after passing by the obstacle, the divided portions being divided by the first discontinuous portions.

6. The powder leveler according to claim 1, wherein the leveling member includes, in a portion that does not come into contact with the obstacle, a second discontinuous portion that extends midway in a direction crossing the axis of the rotation shaft to partially separate a portion of the leveling member that comes into contact with and passes by the obstacle.

7. The powder leveler according to claim 6, wherein the second discontinuous portion is located closer to the obstacle when the first discontinuous portion is located on an opposite side of the rotation shaft from the obstacle.

8. The powder leveler according to claim 7, further comprising:

a release adjusting member at a portion in the structure downstream of the obstacle in a rotation direction of the leveling member, the release adjusting member supporting the leveling member by sequentially releasing divided portions of a bent portion of the leveling member bent after passing by the obstacle, the divided portions being divided by the first discontinuous portions.

9. The powder leveler according to claim 6, further comprising:

a release adjusting member at a portion in the structure downstream of the obstacle in a rotation direction of the leveling member, the release adjusting member supporting the leveling member by sequentially releasing divided portions of a bent portion of the leveling member bent after passing by the obstacle, the divided portions being divided by the first discontinuous portions.

10. The powder leveler according to claim 4, wherein the first discontinuous portions and the second discontinuous portion include either cuts or slits or both a cut and a slit.

11. The powder leveler according to claim 1, further comprising:

a release adjusting member at a portion in the structure downstream of the obstacle in a rotation direction of the leveling member, the release adjusting member supporting the leveling member by sequentially releasing divided portions of a bent portion of the leveling member bent after passing by the obstacle, the divided portions being divided by the first discontinuous portions.

12. The powder leveler according to claim 11, wherein a portion of the release adjusting member that supports the bent portion of the leveling member is spaced a longer distance apart from the rotation shaft toward a downstream side in the rotation direction of the leveling member.

13. The powder leveler according to claim 11, wherein a portion of the release adjusting member that supports the bent portion of the leveling member decreases in height in a direction of the axis of the rotation shaft, on a side downstream of the obstacle in a direction in which the bent portion passes.

14. The powder leveler according to claim 1, wherein the leveling member has a portion located outward of the first end attached to the rotation shaft, in a direction of the axis of the rotation shaft.

15. The powder leveler according to claim 14, wherein the first discontinuous portions are formed in the portion of the leveling member located outward in the direction of the axis of the rotation shaft.

16. The powder container device according to claim 1, wherein the powder leveler is a removable replaceable container that accommodates powder.

17. A powder handling device, comprising:

a powder applicator that applies powder to a powder-receiving object; and a powder container device that accommodates powder reclaimed by the powder applicator, wherein the powder container device includes the powder leveler according to claim 1.

18. A powder handling device, comprising:

a powder applicator that applies powder to a powder-receiving object; and a powder transporter that transports powder to be fed to the powder applicator or powder reclaimed by the powder applicator, wherein the powder transporter includes the powder leveler according to claim 1.

* * * * *